US012644612B2

(12) United States Patent
Yun et al.

(10) Patent No.: US 12,644,612 B2
(45) Date of Patent: Jun. 2, 2026

(54) BOARD ASSEMBLY AND AIR CONDITIONER INCLUDING THE SAME

(71) Applicant: SAMSUNG ELECTRONICS CO., LTD., Suwon-si (KR)

(72) Inventors: Seungjin Yun, Suwon-si (KR); Jeonguk Koh, Suwon-si (KR); Sungtae Kim, Suwon-si (KR); Jaechan Park, Suwon-si (KR); Woong Sun, Suwon-si (KR); Kwangnam Shin, Suwon-si (KR); Wonhee Lee, Suwon-si (KR); Sangmin Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 424 days.

(21) Appl. No.: 18/091,871

(22) Filed: Dec. 30, 2022

(65) Prior Publication Data

US 2023/0304678 A1 Sep. 28, 2023

Related U.S. Application Data

(63) Continuation of application No. PCT/KR2022/020913, filed on Dec. 21, 2022.

(30) Foreign Application Priority Data

Mar. 23, 2022 (KR) ..... 10-2022-0036127

(51) Int. Cl.
*F24F 1/24* (2011.01)
*F24F 1/22* (2011.01)
*F24F 13/20* (2006.01)

(52) U.S. Cl.
CPC ..... *F24F 1/24* (2013.01); *F24F 1/22* (2013.01); *F24F 13/20* (2013.01)

(58) Field of Classification Search
CPC ..... F24F 1/24; F24F 13/20; F24F 1/22; F24F 11/89
See application file for complete search history.

(56) References Cited

U.S. PATENT DOCUMENTS 5,323,292 A 6/1994 Brzezinski
9,025,334 B2 5/2015 Enami et al.
(Continued)

FOREIGN PATENT DOCUMENTS

EP 2549844 A1 * 1/2013 ..... F04B 39/00
JP 2013-26320 A 2/2013
(Continued)

OTHER PUBLICATIONS

Machine English language translation of JP5257599. Translated Apr. 2025 (Year: 2013).*
(Continued)

*Primary Examiner* — Cassey D Bauer
(74) *Attorney, Agent, or Firm* — STAAS & HALSEY LLP

(57) ABSTRACT

An air conditioner may include a control board including a baseboard, and a heating element coupled to the baseboard; a case in contact with the control board, the case accommodating the heating element and including an insulating member; a cooling module to cool the heating element; and a fastening member. The case may be fixed to the cooling module by the fastening member so that the heating element is adjacent to the cooling module, and the insulating member is located between the fastening member and the heating element so as to prevent a current flowing along the fastening member from flowing into the heating element.

16 Claims, 26 Drawing Sheets

(56) References Cited

U.S. PATENT DOCUMENTS

| | | | |
|---|---|---|---|
| 9,769,955 | B2 | 9/2017 | Teraki et al. |
| 9,807,907 | B2 | 10/2017 | Lee et al. |
| 9,877,410 | B2 | 1/2018 | Teraki et al. |
| 10,024,556 | B2 | 7/2018 | Choi et al. |
| 10,222,076 | B2 | 3/2019 | Kim et al. |
| 2015/0082823 | A1 | 3/2015 | Teraki et al. |
| 2017/0115012 | A1 | 4/2017 | Kim et al. |

FOREIGN PATENT DOCUMENTS

| | | | |
|---|---|---|---|
| JP | 2013-135108 | A | 7/2013 |
| JP | 5257599 | | 8/2013 |
| JP | 5408285 | | 2/2014 |
| JP | 5423919 | | 2/2014 |
| JP | 2021-48185 | A | 3/2021 |
| KR | 2003-0072783 | | 9/2003 |
| KR | 10-2009-0061257 | | 6/2009 |
| KR | 10-0952278 | | 4/2010 |
| KR | 10-2015-0031574 | | 3/2015 |
| KR | 10-2015-0043646 | | 4/2015 |
| KR | 10-2015-0125530 | | 11/2015 |
| KR | 10-2017-0048032 | | 5/2017 |

OTHER PUBLICATIONS

International Search Report dated Apr. 10, 2023 for International Application No. PCT/KR2022/020913.
Written Opinion of the International Searching Authority dated Apr. 10, 2023 for International Application No. PCT/KR2022/020913.
Extended European Search Report dated Feb. 20, 2025 for European Application No. 22933789.4.

* cited by examiner

BOARD ASSEMBLY AND AIR CONDITIONER INCLUDING THE SAME

CROSS-REFERENCE TO RELATED APPLICATION(S)

This application is a continuation application, under 35 U.S.C. § 111(a), of international application No. PCT/KR2022/020913, filed on Dec. 21, 2022, which claims priority to Korean Patent Application No. 10-2022-0036127, filed on Mar. 23, 2022, in the Korean Intellectual Property Office, the disclosure of which is incorporated by reference herein in its entirety.

BACKGROUND

1. Field

The disclosure relates to a board assembly and an air conditioner including the same, more particularly, to a board assembly including a structure capable of reducing a temperature of a heating element and an air conditioner including the same.

2. Description of Related Art

An air conditioner is a device that uses a refrigeration cycle to control temperature, humidity, airflow, distribution, etc., for human activities. The refrigeration cycle may be provided to perform a cooling mode for reducing an indoor temperature or a heating mode for increasing the indoor temperature according to a direction in which refrigerant circulates.

An indoor unit of the air conditioner may be configured to cool or heat an indoor space by including an indoor heat exchanger configured to exchange heat between refrigerant and air, an indoor fan configured to flow air, and a motor configured to drive a blower fan.

An outdoor unit of the air conditioner may include an outdoor heat exchanger configured to exchange heat with outdoor air, a compressor configured to compress refrigerant, and a housing in which the outdoor heat exchanger and the compressor are placed.

The housing may include a board assembly for controlling the outdoor unit and the indoor unit.

The board assembly may include a heating element including a semiconductor configured to control the outdoor unit and the indoor unit. The heating element may generate heat while controlling the outdoor unit and the indoor unit. The board assembly may be susceptible to heat, and this needs to be addressed.

SUMMARY

Aspects of embodiments of the disclosure will be set forth in part in the description which follows and, in part, will be apparent from the description, or may be learned by practice of the presented embodiments.

According to an embodiment of the disclosure, an air conditioner may include a control board including a baseboard, and a heating element coupled to the baseboard; a case in contact with the control board, the case accommodating the heating element and including an insulating member; a cooling module to cool the heating element; and a fastening member. The case may be fixed to the cooling module by the fastening member so that the heating element is adjacent to the cooling module, and the insulating member is located between the fastening member and the heating element so as to prevent a current flowing along the fastening member from flowing into the heating element.

According to an embodiment of the disclosure, the case further includes a support between the baseboard and the cooling module, wherein the insulating member extends from the support so as to cover at least a portion of a first side surface of the heating element.

According to an embodiment of the disclosure, the insulating member extends from the support to cover the first side surface, which faces the insulating member, of the heating element.

According to an embodiment of the disclosure, a case opening facing the cooling module is formed in the case, the heating element includes a contact member disposed toward the cooling module through the case opening while the heating element is located inside the case, and the air conditioner further includes a shielding sheet disposed between the contact member and the cooling module so as to prevent a current from flowing between the contact member and the cooling module.

According to an embodiment of the disclosure, the shielding sheet includes a silicone material.

According to an embodiment of the disclosure, the cooling module includes a refrigerant pipe, and a refrigerant pipe support member in contact with the refrigerant pipe, the fastening member is coupled to the refrigerant pipe support member, and the fastening member is provided so that a current generated outside the control board, and which passes through the refrigerant pipe and the refrigerant pipe support member, flows to the fastening member.

According to an embodiment of the disclosure, the case includes an insulating wall extending from the support toward the cooling module and provided to cover at least a portion of a second side surface of the heating element so as to prevent a current generated outside the heating element from flowing to the heating element.

According to an embodiment of the disclosure, the insulating member and the insulating wall are in contact with the shielding sheet.

According to an embodiment of the disclosure, the heating element includes a heating element body, and a lead wire extending from one side of the heating element body to connect the baseboard and the heating element body, and at least some remaining sides of the heating element body are surrounded respectively by the support, the insulating member, the insulating wall, and the shielding sheet.

According to an embodiment of the disclosure, in response to the fastening member being fastened to the cooling module, the fastening member moves the case toward the cooling module so that the heating element is pressed against the cooling module by the case.

According to an embodiment of the disclosure, the heating element includes a first heating element, and a second heating element, the first heating element is provided on a first side of the insulating member, the second heating element is provided on a second side of the insulating member, and in response to the fastening member being fastened to the cooling module, the case presses the first heating element and the second heating element against the cooling module.

According to an embodiment of the disclosure, a first through-hole, through which the fastening member passes, is formed in the support; a second through-hole is formed in the cooling module at a position so that the fastening member passes through the first through-hole into the second through-hole, the air conditioner further includes a support bracket provided in contact with the support and including a third through-hole formed at a position so that the fastening member passes sequentially through the first through-hole, the third through-hole, and the third through-hole, and the fastening member includes a head having a diameter greater than a diameter of the third through-hole, and a neck extending from the head and having a diameter less than the diameter of the head so as to pass through the third through-hole.

According to an embodiment of the disclosure, the first heating element and the second heating element are arranged in a first direction on a first side of the support, the support bracket is located on a second side of the support; and the support bracket has a length in the first direction to at least equal a span of the first heating element and the second heating element in the first direction.

According to an embodiment of the disclosure, the air conditioner further includes an elastic member disposed between the support and the heating element to elastically bias the heating element toward the cooling module.

According to an embodiment of the disclosure, the elastic member includes a first extension extending in a first direction, a second extension extending in a second direction different from the first direction, and a connector connecting the first extension and the second extension, wherein the connector is in contact with the heating element to press the heating element toward the cooling module.

According to an embodiment of the disclosure, an air conditioner may include a control board including a baseboard, and a heating element coupled to the baseboard; a cooling module configured to cool the heating element; a case arranged between the control board and the cooling module, accommodating the heating element, and including an insulating member; a fastening member; and an elastic member arranged between the case and the heating element. The case is fixed to the cooling module by the fastening member so that the insulating member is located between the fastening member and the heating element, and the elastic member presses the heating element against the cooling module.

According to an embodiment of the disclosure, the elastic member includes a first extension extending in a first direction, a second extension extending in a second direction different from the first direction, and a connector connecting the first extension and the second extension, wherein the connector is in contact with the heating element to press the heating element against the cooling module.

According to an embodiment of the disclosure, the elastic member includes a first extension extending in a first direction, a second extension extending in a second direction different from the first direction, and a connector connecting the first extension and the second extension and provided to allow the fastening member to pass therethrough, wherein the first extension and the second extension press the heating element against the cooling module.

According to an embodiment of the disclosure, a board assembly may include a control board including a baseboard, and a heating element coupled to the baseboard; a case accommodating the heating element, and including an insulating member; and a fastening member provided to fasten the case to a cooling module. The case is configured so that the insulating member is located between the fastening member and the heating element so as to prevent a current flowing along the fastening member from flowing into the heating element.

According to an embodiment of the disclosure, the case further includes a support that is arranged between the base board and the cooling module when the case is fastened to the cooling module, wherein the insulating member extends from the support so as to cover at least a portion of a side surface of the heating element.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
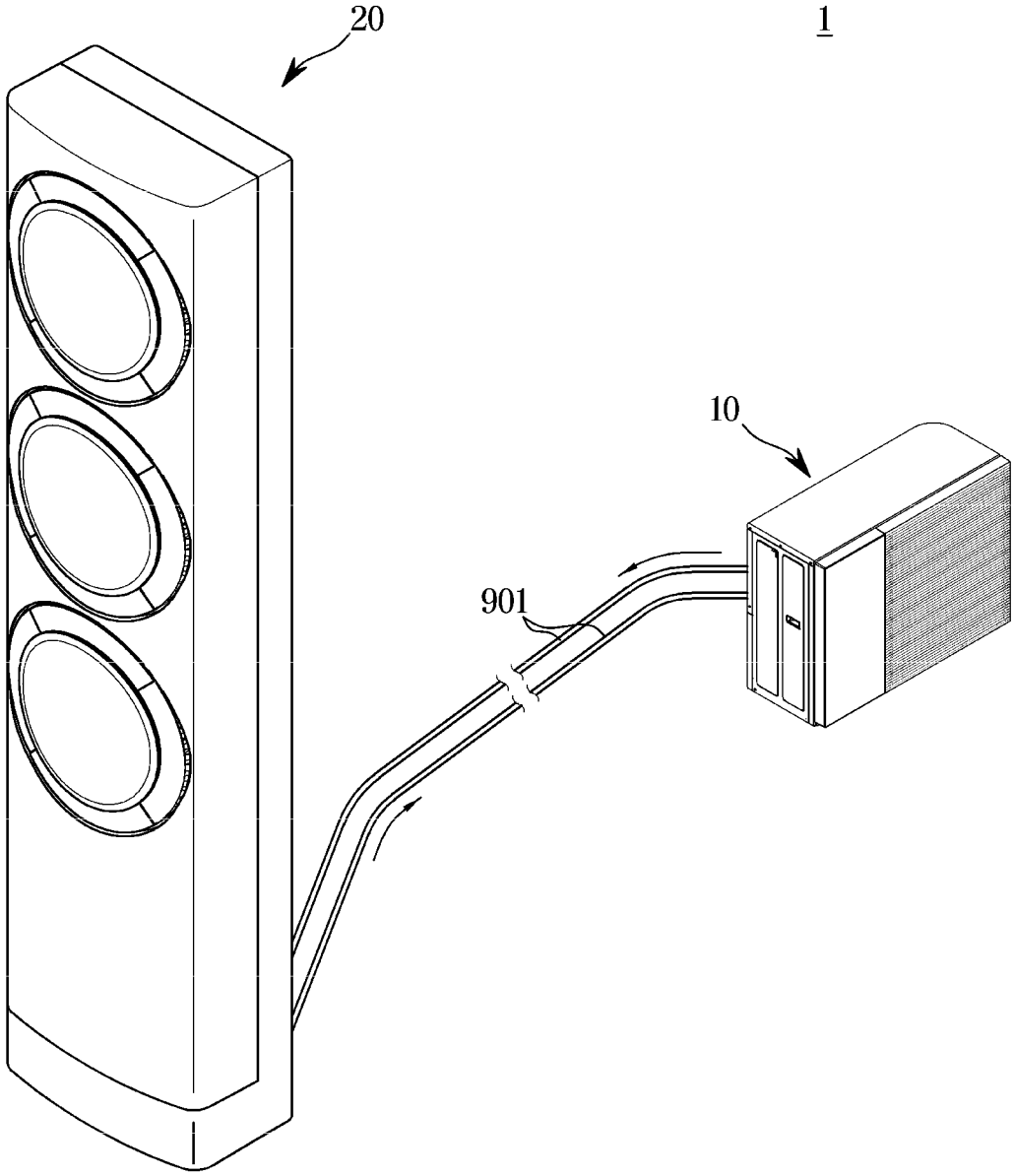
FIG. 1 is a diagram illustrating an appearance of an air conditioner according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "up and down direction", "lower side", "front and rear direction" and the like may be defined by the drawings, but the shape and the location of the component is not limited by the term.

Figure 3:
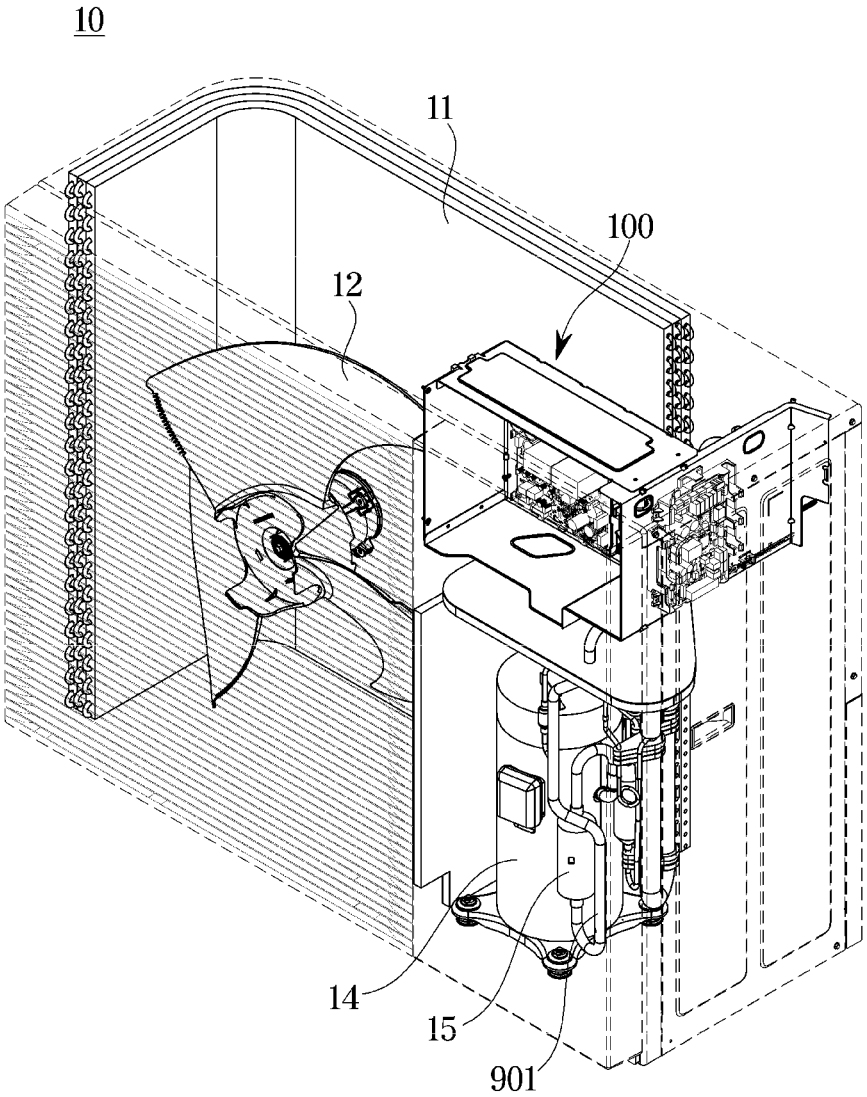
FIG. 3 is a perspective view illustrating an outdoor unit of FIG. 1 according to an embodiment of the disclosure.

Particularly, as shown in FIG. 3, a direction in which an outdoor fan 12 is directed is defined as the front, and thus the rear, left and right sides, and upper and lower sides are defined based on the front side.

Various embodiments of the disclosure provide a board assembly capable of, even when heat is generated by a heating element, reducing damage caused by the heat generated by the heating element or an air conditioner including the same. Various embodiments of the disclosure provide a board assembly capable of effectively dissipating heat generated by a heating element, or an air conditioner including the same. Various embodiments of the disclosure to provide a board assembly capable of preventing electricity from passing between a fastening member, which is capable of fixing a heating element of the board assembly to a cooling module, and the heating element, or an air conditioner including the same.

The disclosure will be described more fully hereinafter with reference to the accompanying drawings.

FIG. 1 is a diagram illustrating an appearance of an air conditioner 1 according to an embodiment of the disclosure.

As illustrated in FIG. 1, the air conditioner 1 may include an indoor unit 20 and an outdoor unit 10. The indoor unit 20 and the outdoor unit 10 may be connected to each other through a refrigerant pipe 901 transmitting a refrigerant. In addition, although not shown in the drawings, the indoor unit 20 and the outdoor unit 10 may be connected to each other through wires for transmitting power and electric signals.

A single outdoor unit 10 may be connected to a plurality of indoor units 20 through the refrigerant pipe 901.

The indoor unit 20 may be disposed in an indoor space, and the outdoor unit 10 may be disposed in an outdoor space.

The air conditioner 1 is a device configured to control temperature, humidity, airflow, distribution, etc., fora user's activity by using a refrigeration cycle.

The refrigeration cycle refers to a cycle of a refrigerant provided to control a temperature of an environment, in which the user is active, according to a movement of heat generated while the refrigerant is evaporated or condensed.

By the refrigeration cycle, it is possible to reduce or increase the temperature of the environment in which the user is active.

The refrigeration cycle typically includes four stages, such as compression, condensation, expansion, and evaporation of the refrigerant. In a cooling mode, the evaporation may be performed in the indoor unit 20, and the compression and condensation may be performed in the outdoor unit 10.

Hereinafter a configuration according to the movement of the refrigerant will be described in detail.

Figure 2:
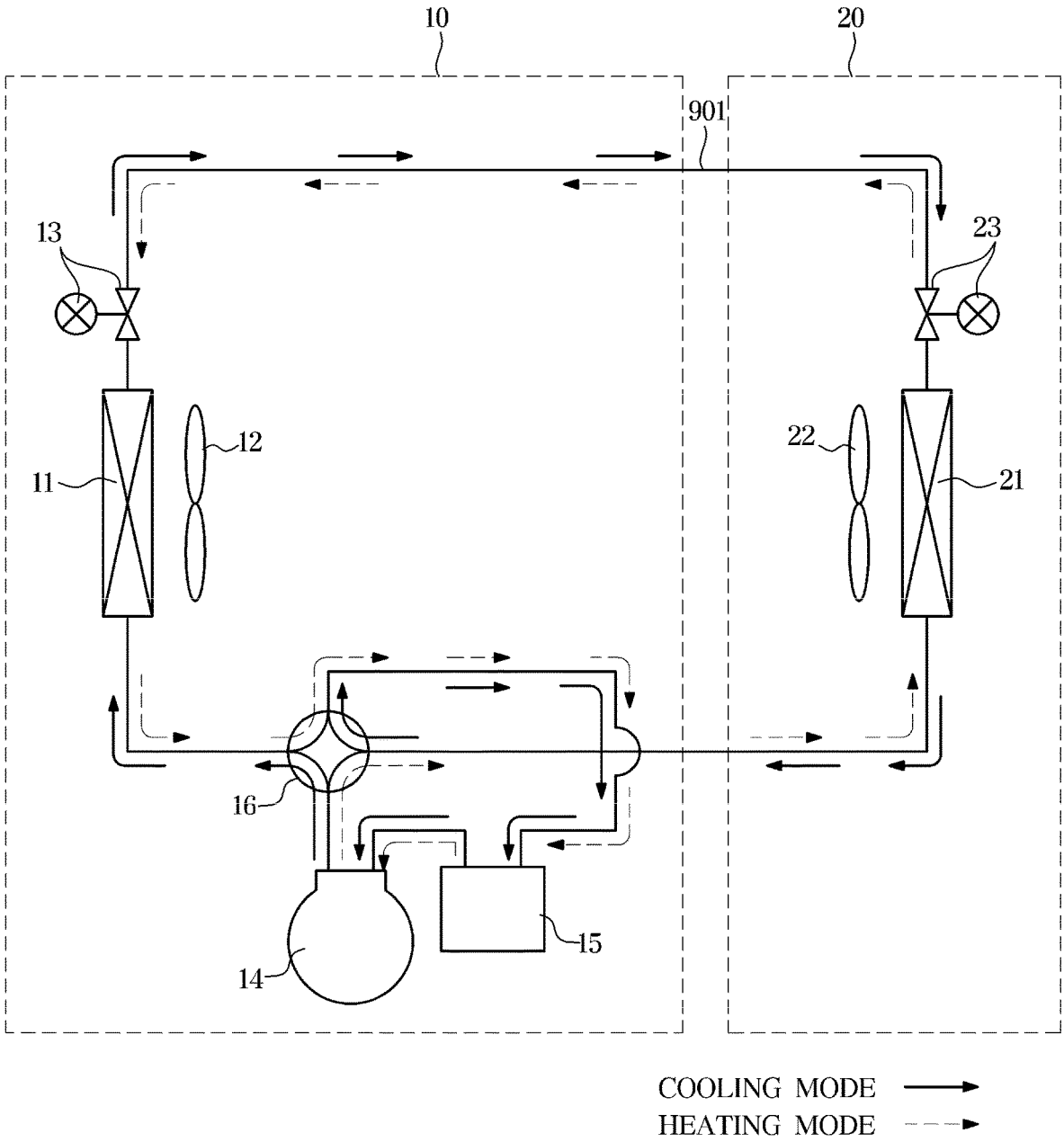
FIG. 2 is a diagram illustrating a configuration related to a flow of refrigerant in the air conditioner of FIG. 1 according to an embodiment of the disclosure.

FIG. 2 is a diagram illustrating a configuration related to a flow of refrigerant in the air conditioner 1 of FIG. 1.

As shown in FIG. 2, the refrigerant may move along the refrigerant pipe 901.

The air conditioner 1 includes the outdoor unit 10, the indoor unit 20, and the refrigerant pipe 901 connecting the outdoor unit 10 and the indoor unit 20 and in which refrigerant moves. The refrigerant pipe 901 extends into the indoor unit 20 and the outdoor unit 10.

The outdoor unit 10 includes a compressor 14 configured to compress refrigerant, an outdoor heat exchanger 11 configured to perform heat exchange between outdoor air and the refrigerant, a four-way valve 16 configured to selectively guide the refrigerant, which is compressed by the compressor 14, to one of the outdoor heat exchanger 11 and the indoor unit 20 according to the heating mode or the cooling mode, an outdoor expansion valve 13 configured to decompress the refrigerant that is guided to the outdoor heat exchanger 11 in the heating mode, and an accumulator 15 configured to prevent liquid refrigerant, which is not evaporated, from flowing to the compressor 14.

The compressor 14 compresses low-pressure gaseous refrigerant to high-pressure refrigerant by using a rotational force of a motor (not shown) of the compressor 14 configured to be rotated by receiving electric energy from an external power source.

The four-way valve 16 guides the refrigerant compressed in the compressor 14 to the outdoor heat exchanger 11 in the cooling mode, and guides the refrigerant compressed in the compressor 14 to the indoor unit 20 in the heating mode.

In the cooling mode, the outdoor heat exchanger 11 condenses the refrigerant compressed in the compressor 14, and in the heating mode, the outdoor heat exchanger 11 evaporates the refrigerant decompressed in the indoor unit 20. The outdoor heat exchanger 11 may include an outdoor heat exchanger cooling fin (not shown) for improving a heat exchange efficiency between the refrigerant and outdoor air by increasing a surface area in which the outdoor air is in contact with the refrigerant pipe 901 of the outdoor heat exchanger 11 through which the refrigerant passes, and the outdoor fan 12 configured to blow outdoor air in the outdoor heat exchanger 11.

The outdoor expansion valve 13 may control the amount of refrigerant provided to the outdoor heat exchanger 11 for the sufficient heat exchange in the outdoor heat exchanger 11, as well as decompressing the refrigerant in the heating mode. Particularly, the outdoor expansion valve 13 may decompress the refrigerant using a throttling action of the refrigerant in which the pressure decreases without heat exchange with the outside when the refrigerant passes through a narrow flow path. The outdoor expansion valve 13 may be provided with an electronic valve configured to regulate an opening degree to control the amount of refrigerant passing through the outdoor expansion valve 13.

The indoor unit 20 includes an indoor heat exchanger 21 configured to perform heat exchange between refrigerant and indoor air, and an indoor expansion valve 23 configured to decompress the refrigerant provided to the indoor heat exchanger 21 in the cooling mode.

The indoor heat exchanger 21 evaporates low-pressure liquid refrigerant in the cooling mode and condenses high-pressure gaseous refrigerant in the heating mode. In the same manner as the outdoor heat exchanger 11 of the outdoor unit 10, the indoor heat exchanger 21 may include a cooling fin (not shown) coupled to the indoor heat exchanger 21 for improving a heat exchange efficiency between the refrigerant of the refrigerant pipe 901, through which the refrigerant passes, connected to the indoor heat exchanger 21 and indoor air, and an indoor fan 22 configured to blow air, which is heat-exchanged with the refrigerant in the indoor heat exchanger 21, to the indoor space.

The indoor expansion valve 23 may control the amount of refrigerant provided to the indoor heat exchanger 21 for the sufficient heat exchange in the indoor heat exchanger 21, as well as decompressing the refrigerant by using the throttling action. The indoor expansion valve 23 may be provided with an electronic valve configured to regulate an opening degree to control the amount of refrigerant passing through the indoor expansion valve 23.

Hereinafter the flow of the refrigerant according to the operation mode of the air conditioner 1, that is, the cooling mode or the heating mode will be described.

In the cooling mode of the air conditioner 1, the refrigerant is compressed to a high pressure by the compressor 14 of the outdoor unit 10. As the refrigerant is compressed, the pressure and temperature of the refrigerant are increased together.

The compressed refrigerant is guided to the outdoor heat exchanger 11 by the four-way valve 16. The refrigerant guided to the outdoor heat exchanger 11 is condensed in the outdoor heat exchanger 11, and the heat exchange is performed between the refrigerant and outdoor air while the refrigerant is condensed. Particularly, while the refrigerant changes from a gaseous state to a liquid state, the refrigerant releases energy (latent heat), which is equal to a difference between internal energy of the gaseous refrigerant and internal energy of the liquid refrigerant, to the outside.

The condensed liquid refrigerant passes through the outdoor expansion valve 13 and then is supplied to the indoor unit 20 through the refrigerant pipe 901.

The liquid refrigerant supplied to the indoor unit 20 is reduced in temperature and reduced in pressure in the indoor expansion valve 23 provided on the refrigerant pipe 901. Particularly, the indoor expansion valve 23 decompresses the refrigerant by using the throttling action of the refrigerant in which the pressure decreases without heat exchange with the outside when the refrigerant passes through a narrow flow path.

The indoor expansion valve 23 may be provided with an electronic valve configured to regulate an opening degree to control the amount of refrigerant introduced into the indoor heat exchanger 21.

The decompressed liquid refrigerant is evaporated in the indoor heat exchanger 21, and the heat exchange is performed between the refrigerant and the indoor air while the refrigerant is evaporated. Particularly, while the refrigerant changes from a liquid state to a gaseous state, the refrigerant absorbs energy (latent heat), which is equal to the difference between the internal energy of the gaseous refrigerant and the internal energy of the liquid refrigerant, from the indoor air.

As described above, in the cooling mode, the air conditioner 1 may cool the indoor air by using heat exchange between the refrigerant and the indoor air in the indoor heat exchanger 21, that is, the refrigerant absorbs latent heat from the indoor air.

The evaporated gaseous refrigerant is provided to the outdoor unit 10 through the refrigerant pipe 901, and is provided to the accumulator 15 through the four-way valve 16. In the accumulator 15, the refrigerant is separated into liquid refrigerant, which is not evaporated, and gaseous refrigerant, which is evaporated, and the gaseous refrigerant is provided to the compressor 14, again.

The gaseous refrigerant provided to the compressor 14 is compressed in the compressor 14, and thus the circulation of the refrigerant is repeated.

In summary of the heat exchange by the refrigerant in the cooling mode of the air conditioner 1, the refrigerant absorbs the thermal energy of the indoor air in the indoor heat exchanger 21 of the indoor unit 20 and the refrigerant emits the thermal energy to the outside in the outdoor heat exchanger 11 of the outdoor unit 10 so as to transfer the thermal energy of the indoor space to the outside.

In the heating mode of the air conditioner 1, the refrigerant is compressed to a high pressure by the compressor 14 of the outdoor unit 10, and the temperature of the refrigerant is increased together with the pressure of the refrigerant.

The compressed refrigerant passes through the four-way valve 16 and is then guided to the indoor unit 20 along the refrigerant pipe 901.

In the indoor heat exchanger 21, the refrigerant is condensed, and the heat exchange is performed between the refrigerant and the indoor air while the refrigerant is condensed. Particularly, the refrigerant releases energy (latent heat), which is equal to the difference between the internal energy of the gaseous state and the internal energy of the liquid state, into the indoor space while the refrigerant changes from the gaseous state to the liquid state. As described above, in the heating mode, the air conditioner 1 may heat the indoor air by using the heat exchange between the refrigerant and the indoor air, in the indoor heat exchanger 21, that is, by using the emission of latent heat by the refrigerant.

The condensed liquid refrigerant passes through the indoor expansion valve 23 and then is supplied to the outdoor unit 10 again along the refrigerant pipe 901.

The liquid refrigerant provided to the outdoor unit 10 is decompressed by the outdoor expansion valve 13 provided on the refrigerant pipe 901, and the temperature of the refrigerant is also reduced. The outdoor expansion valve 13 may be provided with an electronic valve configured to regulate an opening degree to control the amount of refrigerant flowing into the outdoor heat exchanger 11, which will be described later.

The decompressed liquid refrigerant is evaporated in the outdoor heat exchanger 11, and the heat exchange is performed between the refrigerant and outdoor air while the refrigerant is evaporated. Particularly, while the refrigerant changes from a liquid state to a gaseous state, the refrigerant absorbs energy (latent heat), which is equal to the difference between the internal energy of the gaseous refrigerant and the internal energy of the liquid refrigerant, from the outdoor air.

The evaporated gaseous refrigerant in the outdoor heat exchanger 11 is provided to the accumulator 15 through the four-way valve 16. In the accumulator 15, the refrigerant is separated into liquid refrigerant, which is not evaporated, and gaseous refrigerant, which is evaporated, and the gaseous refrigerant is provided to the compressor 14, again.

The gaseous refrigerant provided to the compressor 14 is compressed in the compressor 14, and thus the circulation of the refrigerant is repeated In summary of the heat exchange by the refrigerant, in the heating mode of the air conditioner 1, the refrigerant absorbs the thermal energy of the outdoor air in the outdoor heat exchanger 11 of the outdoor unit 10 and the refrigerant emits the thermal energy to the indoor space in the indoor heat exchanger 21 of the indoor unit 20 so as to transfer the thermal energy of the outdoor space to the indoor space.

In the above description, the flow of the refrigerant is described with the phase change of the refrigerant. However, the refrigerant that is described as a liquid phase or a liquid state may include a state in which a liquid phase and a gaseous phase are mixed, and the refrigerant that is described as a gaseous phase or a gaseous state may include a state in which the gaseous phase and the liquid phase are mixed.

Hereinafter, for convenience of description, it is assumed that the refrigeration cycle performs the cooling mode. However, the disclosure is not limited thereto.

If the air conditioner 1 operates in the cooling mode, a user may want to constantly maintain an indoor temperature at a target temperature. The user can control the compressor 14 so as to control the temperature. When the compressor 14 controls a speed of compressing the refrigerant, a speed at which the refrigerant circulates to the indoor unit 20 and the outdoor unit 10 through the refrigerant pipe 901 may be controlled. Accordingly, it is possible to control cooling of the indoor space.

However, controlling the indoor temperature by controlling the compressor 14 will be described as an example, but is not limited thereto. The present embodiment may be equally applied to another control method as long as the indoor temperature is controlled.

A control board 110 (refer to FIG. 4) may be provided to control a refrigerant compression speed of the compressor 14. A description related thereto will be described in detail with reference to FIG. 3.

FIG. 3 is a perspective view illustrating the outdoor unit 10 of FIG. 1.

As illustrated in FIG. 3, the outdoor unit 10 may include the outdoor heat exchanger 11 and the outdoor fan 12. The outdoor fan 12 may allow the heat exchange of the refrigerant to be actively performed in the outdoor heat exchanger 11. The refrigerant pipe 901 through which the refrigerant flows may be disposed by passing though the outdoor heat exchanger 11.

The compressor 14 configured to compress the refrigerant and the accumulator 15 configured to temporarily store the refrigerant may be arranged on one side of the outdoor heat exchanger 11. As illustrated in FIG. 2, the refrigerant passing through the indoor unit 20 may pass through the accumulator 15 and flow into the compressor 14. The refrigerant flowing into the compressor 14 may be compressed and the compressed refrigerant may flow into the outdoor heat exchanger 11.

The outdoor unit 10 may include a board assembly 100 including the control board 110 (FIG. 4) for controlling the refrigerant compression speed of the compressor 14.

A method, in which the operation of the compressor 14 is stopped in response to the indoor temperature being equal to a target temperature, and the compressor 14 operates again in response to the indoor temperature not being equal to the target temperature, may be used as the method in which the indoor temperature is controlled by controlling the speed of the compressor 14.

A method, in which a speed of a motor (not shown) configured to drive the compressor 14 is reduced in response to the indoor temperature being equal to a target temperature and the speed of the motor is increased in response to the indoor temperature not being equal to the target temperature, may be used as the method of controlling the indoor temperature.

As for using the method of reducing the speed of the motor configured to drive the compressor 14, the compressor 14 may include a converter (not shown) and an inverter (not shown) for controlling the speed of the motor.

The converter is a component configured to convert an AC voltage into a DC voltage or convert a DC voltage into a DC voltage having another voltage.

A voltage that is converted into DC by the converter is introduced into the inverter. The inverter may control a frequency of the DC voltage to have a voltage having a desired frequency.

A voltage converted by the inverter may be introduced into the motor to allow the motor to have a desired rotation speed, thereby controlling the refrigerant compression speed of the compressor 14. Therefore, it is possible to control the indoor temperature by controlling the inverter.

As mentioned above, the control board 110 (refer to FIG. 4) included in the board assembly 100 may control the inverter to transmit a voltage of a desired frequency to the motor in order to control the indoor temperature.

Therefore, in the following description, it is assumed that the control board 110 (refer to FIG. 4) controls the inverter of the compressor 14. However, the disclosure is not limited thereto. Further, the control board 110 may be applied to a configuration such as the outdoor expansion valve 13 (refer to FIG. 3) or the indoor expansion valve 23 (refer to FIG. 4) configured to control the indoor temperature.

Hereinafter the board assembly 100 including the control board 110 configured to control the inverter will be described in more detail.

Figure 4:
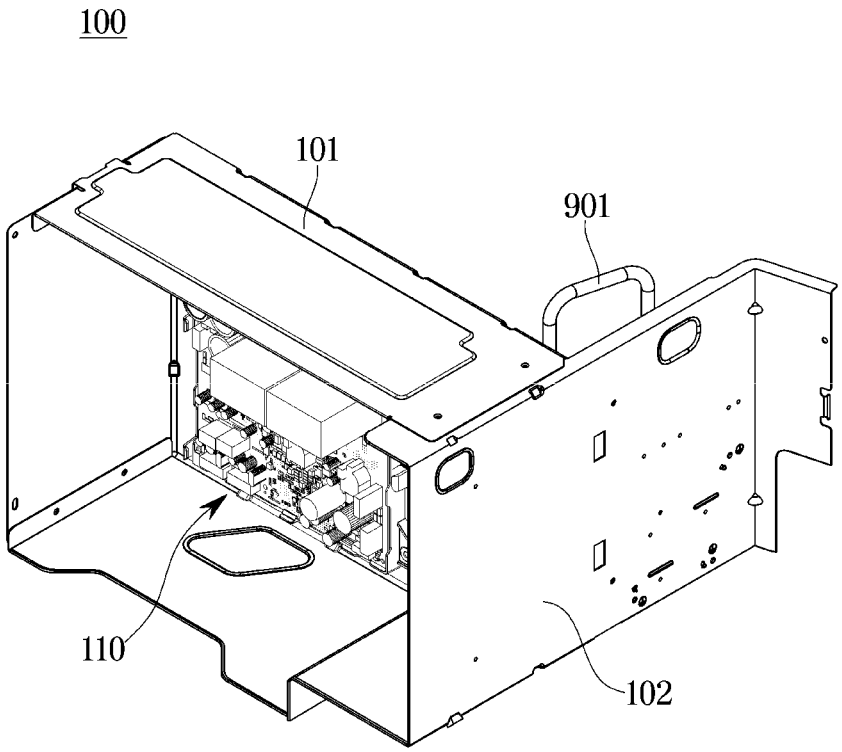
FIG. 4 is a perspective view illustrating a board assembly of FIG. 3 according to an embodiment of the disclosure.

FIG. 4 is a perspective view illustrating the board assembly 100 of FIG. 3.

As shown in FIG. 4, the board assembly 100 includes the control board 110. The control board 110 may include a control box body 101 and a side control box 102 which surround the control board 110 to allow the control board 110 to be installed inside the outdoor unit 10. As the control box body 101 and the side control box 102 surround the control board 110, the control board 110 may be protected from an external impact.

A structure as shown in FIG. 4 is only an example. Accordingly, the control board 110 may be provided in plurality, and the plurality of control boards 110 may be provided to be attached to the control box body 101 or the side control box 102.

Figure 5:
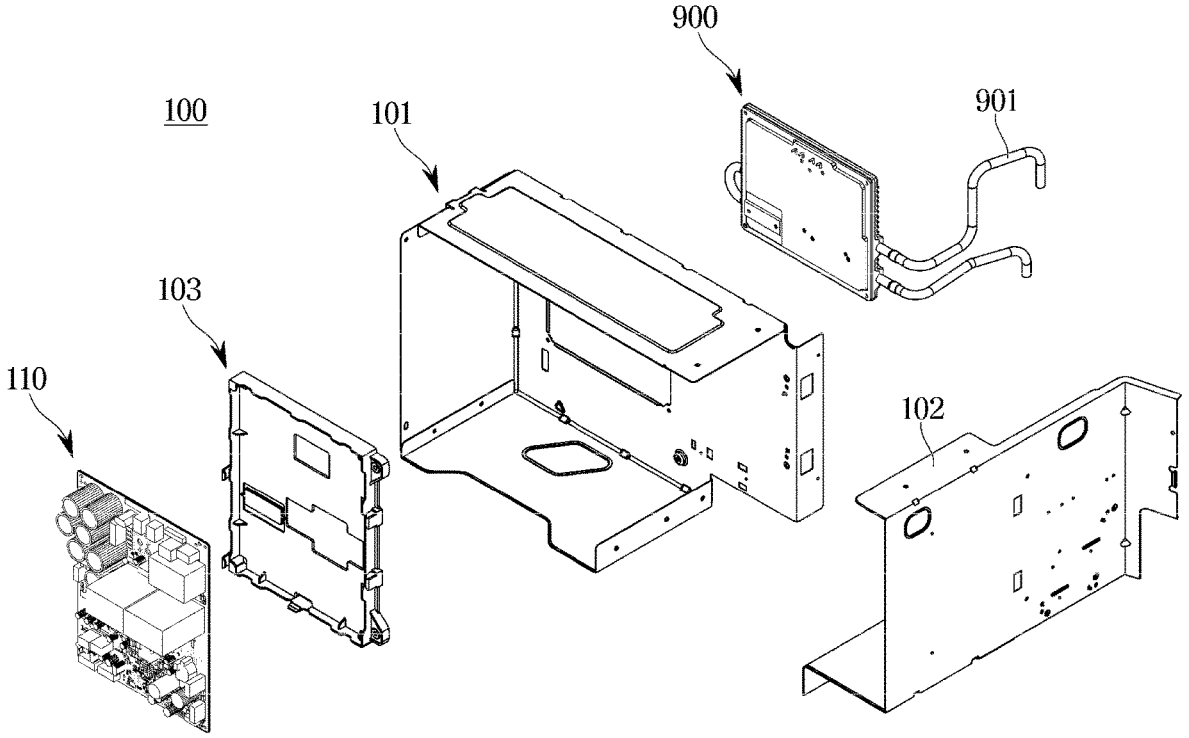
FIG. 5 is an exploded perspective view illustrating the board assembly of FIG. 4 according to an embodiment of the disclosure.

FIG. 5 is an exploded perspective view illustrating the board assembly 100 of FIG. 4.

As shown in FIG. 5, a board bracket 103 may be provided at the rear side of the control board 110. A recess corresponding to the control board 110 may be provided in the board bracket 103 to accommodate the control board 110.

A hole formed in a shape corresponding to an electrical component 112 provided behind the control board 110 may be formed on the board bracket 103 to allow the electrical component 112 provided behind the control board 110 to pass through the board bracket 103 and protrude to the rear side.

The board bracket 103 may be fixed to the control box body 101. The control board 110 may be accommodated and fixed in the recess of the board bracket 103. Accordingly, as the board bracket 103 is fixed to the control box body 101, the control board 110 may be fixed to the control box body 101.

The control box body 101 may be provided with a hole to allow the electrical component 112 provided behind the control board 110 to protrude to the rear side so as to be adjacent to a cooling module 900. In other words, the electrical component 112 provided behind the control board 110 may pass through the hole provided in the board bracket 103 and the hole provided in the control box body 101 so as to be disposed adjacent to the cooling module 900.

Based on the above-mentioned structure, it is seen that the control box body 101, the side control box 102, and the board bracket 103 are components not related to cooling the control board 110. Hereinafter the disclosure will be described with reference to the drawings in which the control box body 101, the side control box 102, and the board bracket 103 are removed.

Figure 6:
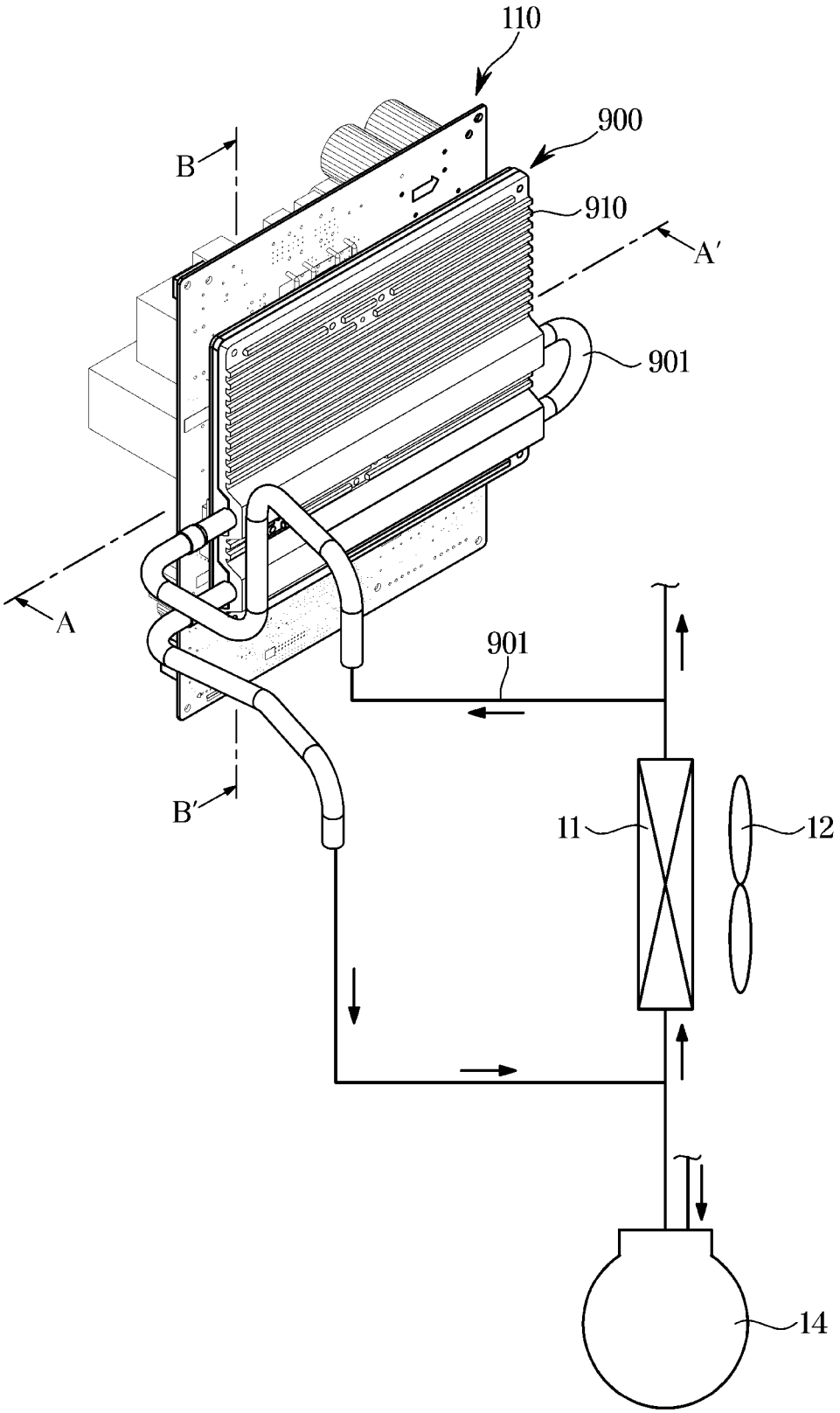
FIG. 6 is a rear perspective view illustrating a state in which a control box body, a side control box, and a board bracket are removed from the board assembly of FIG. 4 according to an embodiment of the disclosure.

FIG. 6 is a rear perspective view illustrating a state in which the control box body 101, the side control box 102, and the board bracket 103 are removed from the board assembly 100 of FIG. 4.

As shown in FIG. 6, the cooling module 900 may be positioned adjacent to the rear of the control board 110. The control board 110 may generate heat while controlling the converter of the compressor 14. Because the control board 110 is susceptible to heat, the cooling module 900 serving as a heat sink may be located adjacent to the control board 110 to reduce heat generated from the control board 110.

The cooling module 900 may include the refrigerant pipe 901. The heat of the control board 110 may be transferred to the refrigerant passing through the refrigerant pipe 901 and thus the temperature of the control board 110 may be reduced. The cooling module 900 may include a refrigerant pipe support member 910 to stably position the refrigerant pipe 901 to be adjacent to the control board 110.

At this time, the refrigerant pipe 901 may include a metal material to facilitate heat transfer to the refrigerant. The refrigerant pipe support member 910 may include a metal material to facilitate heat transfer to the refrigerant pipe 901.

Refrigerant that cools the heat of the control board 110 may be refrigerant passed through the outdoor heat exchanger 11. The refrigerant after cooling the control board 110 may be moved toward the outdoor heat exchanger 11 again.

For a normal operation of the control board 110, it is appropriate that the control board 110 has a temperature of 90 degrees or less. In general, the refrigerant passing through the outdoor heat exchanger 11 may have a temperature of about 50 degrees. Accordingly, it is possible to reduce the temperature of the control board 110 to 90 degrees or less by using the refrigerant passing through the outdoor heat exchanger 11.

Particularly, it is possible to reduce the temperature of the control board 110 by using the refrigerant that already passes through the outdoor heat exchanger 11 and does not pass through the indoor expansion valve 23. The refrigerant that already reduces the temperature of the control board 110 may pass through the compressor 14 and may be mixed with refrigerant directed to the outdoor heat exchanger 11, and the mixed refrigerant may be directed toward the outdoor heat exchanger 11.

However, although it is illustrated that the cooling module 900 employs a cooling method using refrigerant, in the drawings, the disclosure may be applied to a cooling method using air. As for the cooling method using air, a cooling fin (not shown) may be arranged behind the control board 110, so as to cool the control board 110.

Figure 7:
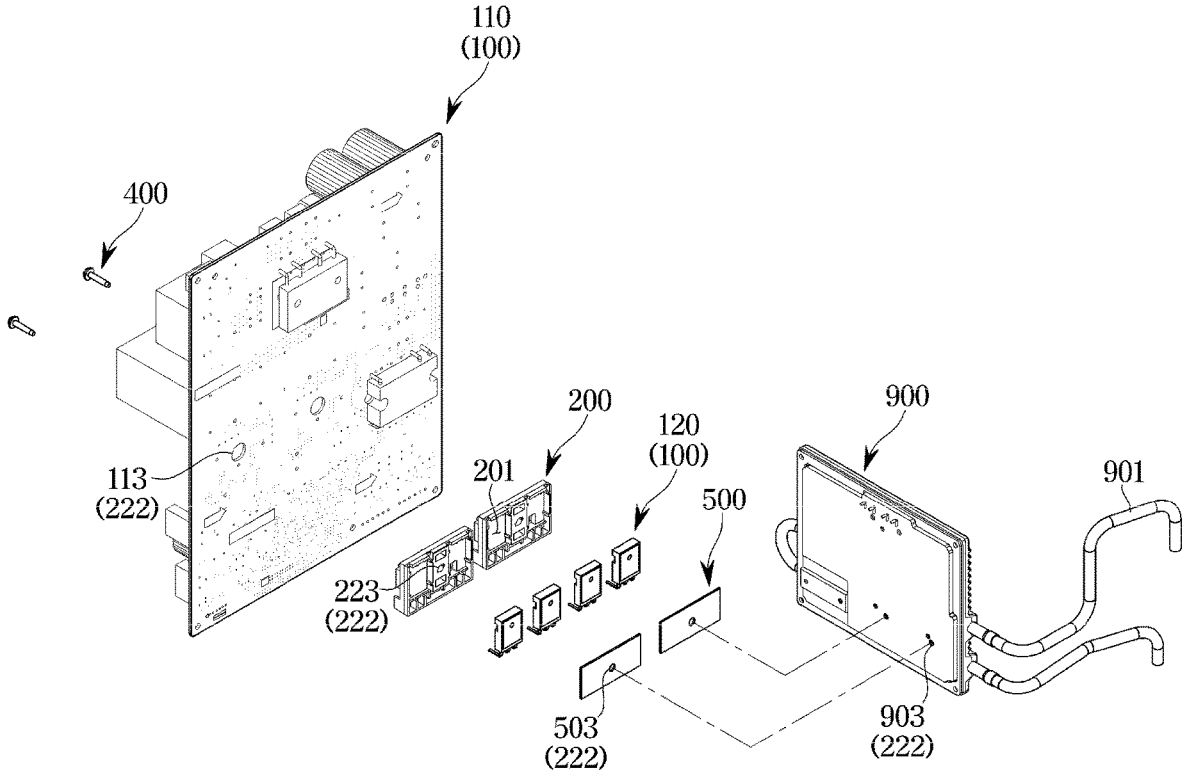
FIG. 7 is an exploded perspective view illustrating the board assembly of FIG. 6 according to an embodiment of the disclosure.

FIG. 7 is an exploded perspective view illustrating the board assembly 100 of FIG. 6.

As shown in FIG. 7, the board assembly 100 may include the control board 110 and a configuration for mounting the control board 110 to the cooling module 900.

The control board 110 may include a baseboard 111 and the electrical component 112 mounted thereon. A heating element 120 generating heat may be mounted on the baseboard 111 of the control board 110. The heating element 120 may be the electrical component 112 that generates heat.

The board assembly 100 may include a case 200 positioned between the heating element 120 and the baseboard 111 so as to accommodate the heating element 120. The case 200 may include a case opening 201 opened rearward. The heating element 120 may be accommodated inside the case 200 to be directed to the case opening 201.

However, this is only an example, and the heating element 120 may be accommodated in the case 200 in which the case opening 201 is not formed.

The case 200 may be press-fitted to the baseboard 111 through a through hole formed in the baseboard 111.

The board assembly 100 may include a shielding sheet 500 disposed between the heating element 120 and the cooling module 900. The shielding sheet 500 may include an insulator. The shielding sheet 500 may prevent a current from flowing between the heating element 120 and the cooling module 900. Particularly, the shielding sheet 500 may be arranged between a contact member 126 (refer to FIG. 9), which is arranged toward the cooling module, in the heating element 120, and the cooling module 900 so as to prevent electricity from passing between the contact member 126 (refer to FIG. 9) and the cooling module 900.

The control board 110 may be mounted to the cooling module 900 by a fastening member 400.

When the fastening member 400 mounts the control board 110 to the cooling module 900, the fastening member 400 may be mounted to the cooling module 900 by passing through a through-hole 222. The through-hole 222 may include a first through-hole 223 to a sixth through-hole 631*d* (refer to FIG. 20).

The first through-hole 223 may be formed in the case 200. A second through-hole 903 may be formed in the cooling module 900. A third through-hole 303 may be formed in a support bracket 300 (refer to FIG. 12) accommodated in the case 200. A fourth through-hole 113 may be provided in the baseboard 111. A fifth through-hole 503 may be formed in the shielding sheet 500.

In order to smoothly mount the fastening member 400 to the cooling module 900, the first through-holes 223 to the fifth through-holes 503 may be formed at corresponding positions.

In response to the fastening member 400 being fastened to the cooling module 900, the cooling module 900 may be disposed to correspond to a position of the fastening member 400.

Hereinafter components included in the board assembly 100 will be described in detail one by one.

Figure 8:
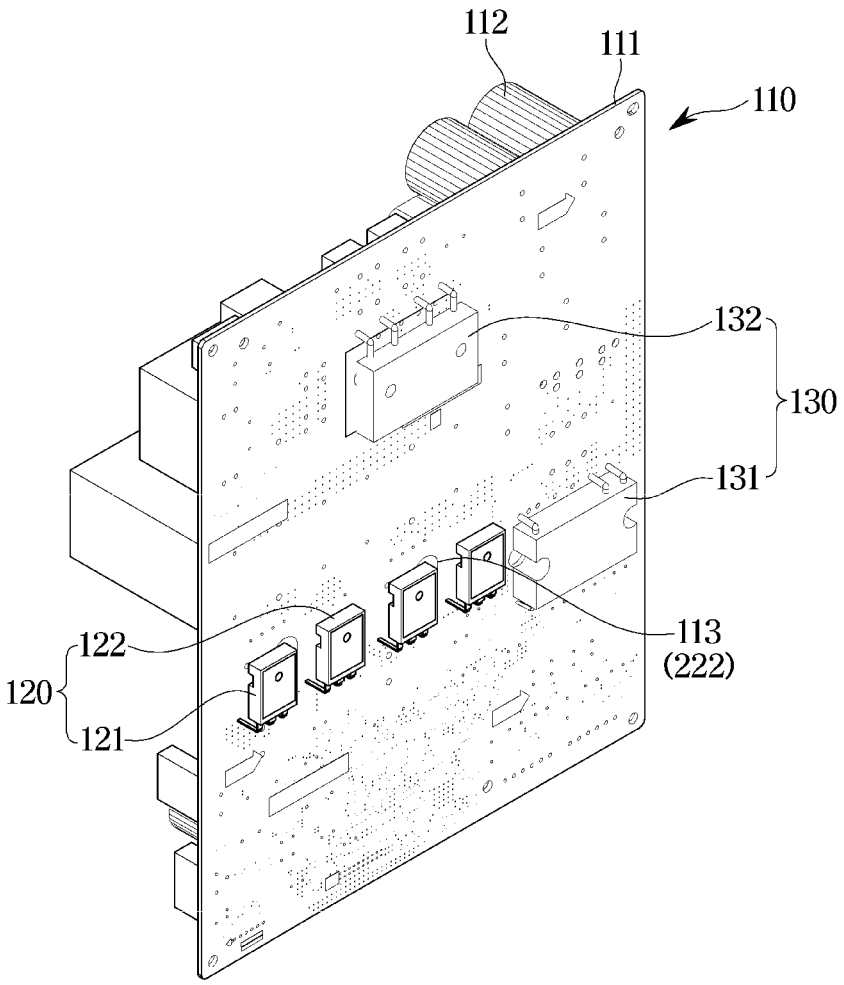
FIG. 8 is a rear perspective view illustrating a control board of FIG. 7 according to an embodiment of the disclosure.

FIG. 8 is a rear perspective view illustrating the control board 110 of FIG. 7.

As shown in FIG. 8, the control board 110 may include the baseboard 111. The baseboard 111 may have a plate shape. The electrical component 112 may be mounted on one surface of the baseboard 111, and a component generating heat may be disposed on the other surface. Accordingly, it is possible to protect the electrical component 112 that does not generate heat.

In addition, because a component generating a lot of heat is arranged on one side of the baseboard 111 close to the cooling module 900, a temperature of the component may be effectively reduced by the cooling module 900.

The component generating heat may be disposed adjacent to the refrigerant pipe support member 910 of the cooling module 900 so as to reduce the temperature.

The heating element 120 generating heat may be disposed behind the baseboard 111. The heating element 120 may include a semiconductor for controlling the inverter. The heating element 120 may include an insulated gate bipolar transistor (IGBT). IGBT is a semiconductor specialized for fast control. Particularly, the heating element 120 may be a semiconductor for controlling a power factor correction circuit.

At this time, the power factor refers to a ratio of active power that actually works to power supplied when electricity is used. A phase difference between a current and a voltage may occur in the AC power source, and thus an amount of power, which is obtained based on the phase difference, may be less than an amount of power obtained based on no phase difference. A circuit that reduces the phase difference to allow the inverter to have higher power is the power factor correction circuit.

The semiconductor configured to control the power factor correction circuit is required to be controlled at a high speed, and thus a large amount of heat may be generated. Accordingly, the heating element 120 may have a high temperature.

The heating element 120 may include fast recovery diodes (FRDs) in order to effectively control the inverter. The FRD may also have a high temperature in the same manner as the IGBT.

In order to effectively cool the heating element 120, the heating element 120 may be arranged in a direction in which the refrigerant pipe 901 extends.

The heating element 120 may include a first heating element 121 and a second heating element 122. The first heating element 121 and the second heating element 122 may be arranged in a direction in which the refrigerant pipe 901 extends. Accordingly, the first heating element 121 and the second heating element 122 may be disposed more adjacent to the refrigerant pipe 901.

The control board 110 may include a semiconductor device 130 disposed behind the baseboard 111. An outer surface of the semiconductor device 130 may be surrounded by plastic. Accordingly, a portion of the semiconductor device 130 in contact with the cooling module 900 may be plastic.

The semiconductor device 130 may include a first semiconductor device 131 arranged in an arrangement direction of the first heating element 121 and the second heating element 122. The first semiconductor device 131 may include an intelligent power module (IPM). Because the IPM performs a high-speed operation, a temperature of the IPM may be increased.

The semiconductor device 130 may include a second semiconductor device 132 arranged in a direction different from the arrangement direction of the first heating element 121 and the second heating element 122. Because a width of the baseboard 111 of the control board 110 is limited, it may be difficult to position the second semiconductor device 132 to be on the same line as the extending direction of the refrigerant tube 901. Accordingly, the second semiconductor device 132 may be disposed in a direction different from the arrangement direction of the first heating element 121 and the second heating element 122.

The second semiconductor device 132 may include a bridge diode. The bridge diode may have a lower temperature than the IPM. Therefore, although the second semiconductor device 132 is not arranged in the extending direction of the refrigerant pipe 901, a temperature of the second semiconductor device 132 may be sufficiently reduced by being in contact with the refrigerant pipe support member 910.

The semiconductor device 130 may be configured such that a plastic structure is in contact with the cooling module 900. The heating element 120 may include a structure different from that of the semiconductor device 130. Hereinafter the structure of the heating element 120 will be described in detail.

Figure 9:
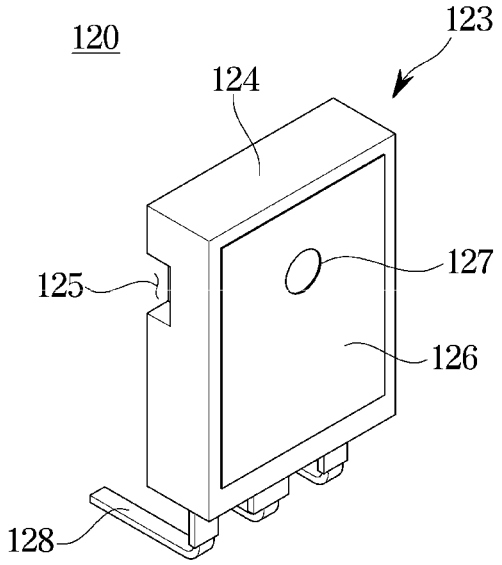
FIG. 9 is a rear perspective view illustrating a heating element of FIG. 8 according to an embodiment of the disclosure.

FIG. 9 is a rear perspective view illustrating the heating element 120 of FIG. 8.

As illustrated in FIG. 9, the heating element 120 may include a heating element body 123 and a lead wire 128 extending from the heating element body 123.

The lead wire 128 may extend from a side surface of the heating element 120. The lead wire 128 may extend from the side surface of the heating element 120 and be bent toward the baseboard 111. Accordingly, when the lead wire 128 is connected to the baseboard 111, a side, having a large surface area, of the heating element body 123 may be directed to the cooling module 900. When the heating element body 123 and the cooling module 900 are in contact with each other, a contact area may be increased, and thus cooling efficiency may be increased by the structure of the lead wire 128.

The heating element body 123 may include a heating element cover 124 provided to cover a semiconductor (not shown) positioned therein. The heating element cover 124 may include an insulator. It is difficult for the semiconductor to perform an intended function due to an electrical stimulus, and thus it is appropriate that the heating element cover 124 is an insulator.

The heating element cover 124 may include a cover groove 125 formed in a side surface thereof to communicate with the outside so as to easily dissipate the heat of the semiconductor.

The heating element body 123 may include the contact member 126 disposed on a side facing the cooling module 900. The contact member 126 may include a non-insulating material. Particularly, the contact member 126 may include a metal material. The semiconductor may be positioned inside the heating element 120. In order for the semiconductor to well dissipate heat to the outside of the heating element 120, it is appropriate that a material having high thermal conductivity is disposed around the semiconductor. Because the heat of the semiconductor moves toward the cooling module 900, it is appropriate that the contact member 126 disposed between the semiconductor and the cooling module 900 is a metal having high thermal conductivity in terms of reducing the temperature of the heating element 120.

A contact member hole 127 may be formed on the contact member 126 so as to increase a surface area thereof. As the surface area of the contact member 126 is increased, the cooling efficiency of the semiconductor may be further increased.

The above-mentioned heating element 120 may be accommodated in the case 200. Hereinafter the case 200 will be described in detail.

Figure 10:
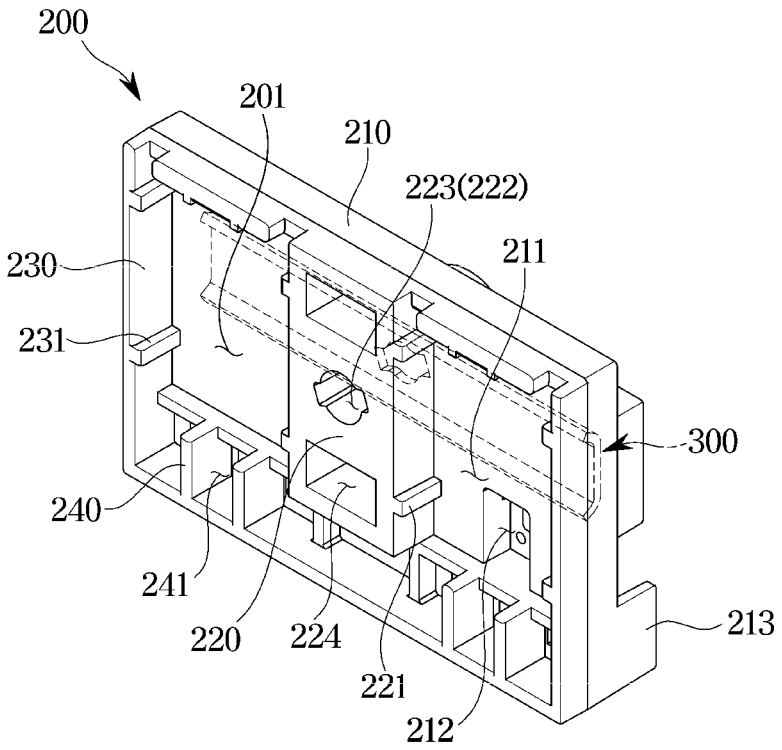
FIG. 10 is a rear perspective view illustrating a case of FIG. 6 according to an embodiment of the disclosure.

FIG. 10 is a rear perspective view illustrating the case 200 of FIG. 6.

As shown in FIG. 10, the case 200 may include a support 210. The support 210 may have a plate shape.

The support 210 of the case 200 may be disposed between the heating element 120 and the baseboard 111. An electric circuit may be printed on the baseboard 111. Therefore, it is required to prevent the baseboard 111 from increasing in temperature in order to perform a target function. The support 210 of the case 200 may prevent heat, generated from the heating element 120, from being transferred to the baseboard 111.

The support 210 may be disposed between the heating element 120 and the cooling module 900.

The case 200 may include an insulating member 220 extending from the support 210 toward the cooling module 900. The first through hole 223 may be formed by penetrating the insulating member 220.

The fastening member 400 may penetrate the first through-hole 223 and thus the insulating member 220 may be disposed between the fastening member 400 and the heating element 120. Accordingly, a current flowing along the fastening member 400 may be prevented from flowing to the heating element.

The insulating member 220 may be provided to cover at least a portion of the side surface of the heating element 120. In other words, the insulating member 220 may extend from the support 210 to cover at least a portion of the side surface of the heating element.

The insulating member 220 may extend toward the cooling module 900 to cover the side surface, which faces the insulating member 220, in the heating element 120.

As will be further described below, electricity may flow through the fastening member 400. Because the heating element 120 includes a semiconductor, it is required to prevent the flow of the electric current. Accordingly, the insulating member 220 preventing the flow of the electric current is required between the heating element 120 and the fastening member 400.

The first heating element 121 may be disposed on one side of the insulating member 220. The second heating element 122 may be disposed on the other side of the insulating member 220. At this time, the case 200 may press the first heating element 121 and the second heating element 122 against the cooling module 900 when the fastening member 400 is fastened to the cooling module 900.

As mentioned above, as the case 200 presses the first heating element 121 and the second heating element 122 against the cooling module 900, it is possible to use only the fastening member 400 pressing the case 200 without the use of the fastening member 400 pressing the first heating element 121 and the second heating element 122. That is, it is possible to reduce the number of the fastening members 400 used for the board assembly 100. Due to the reduction in the number of the fastening members 400, it is possible to reduce a time for producing the board assembly 100 in the process of producing the board assembly 100. In addition, when a producer directly fastens the fastening member 400, the labor intensity of the producer may be reduced.

An auxiliary recess 224 that is positioned in a vertical direction of the first through hole 223 and recessed forward may be formed. Due to the auxiliary recess 224, it is possible to increase a strength of the case 200. When the case 200 is formed by injection molding, shrinkage of the case 200 may be prevented by the auxiliary recess 224.

The case 200 may include an insulating wall 230 extending from the support 210 toward the cooling module 900 and provided to cover at least a portion of the side surface of the heating element 120 that is not covered by the insulating member 220.

In other words, the insulating member 220 and the insulating wall 230 may cover at least a portion of the side surface of the heating element 120 placed on the case 200.

Accordingly, it is possible to prevent electricity generated from the outside of the heating element 120 from flowing to the heating element 120.

At this time, a space in which the heating element 120 is accommodated may be referred to as a mounting space 211. The mounting space 211 may be surrounded by the insulating member 220 and the insulating wall 230.

The case opening 201 opened toward the cooling module 900 may be formed at the rear of the mounting space 211. When the heating element 120 is positioned inside the case 200, the contact member 126 of the heating element 120 is disposed toward the case opening 201.

A sensor space 212 recessed forward may be provided in front of the mounting space 211. A sensor configured to measure the temperature of the heating element 120 may be positioned in the sensor space 212.

The case 200 may include a first spacing rib 231 extending from the insulating wall 230 toward the mounting space 211. The first spacing rib 231 may prevent the insulating wall 230 from being in contact with the heating element 120, thereby preventing electricity generated from the outside of the heating element 120 from flowing to the heating element 120.

The case 200 may include a second spacing rib 221 extending from the insulating member 220 toward the mounting space 211. The second spacing rib 221 may prevent the insulating member 220 from being in contact with the heating element 120, thereby preventing electricity, which flows through the fastening member 400, from flowing to the heating element 120.

The lead wire 128 of the heating element 120 may be provided in plurality. In order to prevent an electrical interference between the plurality of lead wires 128, a partition rib 240 extending from the support 210 may be provided between the plurality of lead wires 128.

The partition rib 240 may be provided in plurality. A lead wire space 241 in which the lead wire 128 extends may be provided between the partition rib 240 and the partition rib 240. The lead wire space 241 may be provided between the partition rib 240 and the insulating wall 230.

The case 200 may allow the lead wire 128 of the heating element 120 to be stably mounted on the baseboard 111. The lead wire 128 passing through the lead wire hole 242 (shown in FIG. 11) may be guided by a portion of the case 200, forming the lead wire hole 242, so as to be mounted on the baseboard 111. Accordingly, even when an impact is applied to the heating element 120, the lead wire 128 may be prevented from being detached from the baseboard 111.

Figure 11:
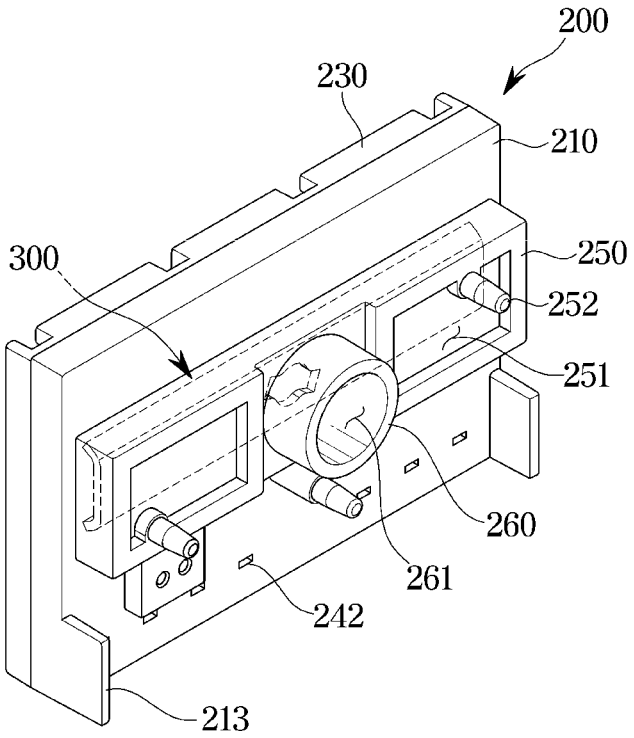
FIG. 11 is a perspective view illustrating the case of FIG. 10 according to an embodiment of the disclosure.

FIG. 11 is a perspective view illustrating the case 200 of FIG. 10.

As illustrated in FIG. 11, the case 200 may a support protruding member 250 formed in a front portion of the 200 and protruding from the support 210 toward the baseboard 111. The support protruding member 250 may have a thickness corresponding to a length from the support 210 to the baseboard 111. Accordingly, the support 210 and the baseboard 111 may be supported by the support protruding member 250.

A support recess 251 recessed backward may be formed in the support protruding member 250. By forming the support recess 251, a strength of the support protruding member 250 may be increased.

The case 200 may include a support protrusion 252 extending from the support protruding member 250 toward the baseboard 111 of the control board 110. The support protrusion 252 may be inserted into the baseboard 111 to couple the case 200 to the baseboard 111.

The case 200 may include a support flange 213 extending from an edge of the support 210 toward the baseboard 111. The support flange 213 may extend as much as the thickness of the support protruding member 250 so as to allow the case 200 to be supported against the baseboard 111.

The case 200 may include a receiving hole forming member 260 extending from the supporting 210 toward the fourth through-hole 113 formed in the baseboard 111. A receiving hole 261 may be formed inside the receiving hole forming member 260 to be connected to the first through-hole 223 formed by penetrating the insulating member 220.

When the heating element 120 is accommodated inside the case 200, a lead wire hole 242 may be formed at a position corresponding to the lead wire 128. The lead wire 128 may be connected to the baseboard 111 by passing through the lead wire hole 242.

Figure 12:
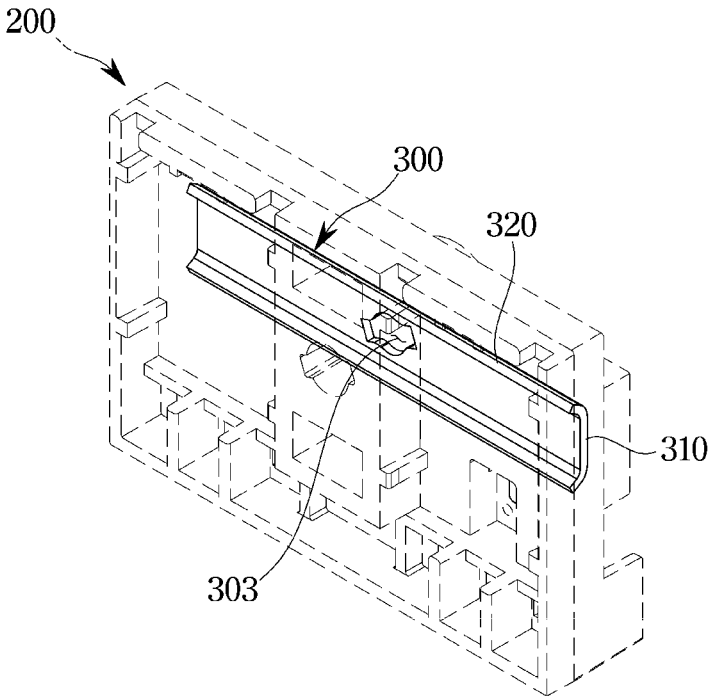
FIG. 12 is a rear perspective view illustrating a support bracket accommodated in the case of FIG. 10 according to an embodiment of the disclosure.

FIG. 12 is a rear perspective view illustrating the support bracket 300 accommodated in the case 200 of FIG. 10.

As shown in FIG. 12, the support bracket 300 may be accommodated in the case 200. The support bracket 300 may evenly distribute a pressure applied to the case 200 when the fastening member 400 is fastened to the cooling module 900. In addition, when the fastening member 400 is fastened to the cooling module 900, the support bracket 300 may prevent the case 200 from being damaged.

The support bracket 300 may be provided by insert molding into the case 200. At this time, the support bracket 300 and the case 200 may be simultaneously disposed, and thus a production time of the board assembly 100 may be reduced.

The support bracket 300 may include a bracket flat member 310 extending in the left and right direction. The third through-hole 303 may be formed at a position, corresponding to the first through-hole 223, on the bracket flat member 310. The fastening member 400 may pass through the third through-hole 303 to be coupled to the cooling module 900.

Along the direction in which the case 200 extends, the bracket flat member 310 may extend. Accordingly, the bracket flat member 310 may evenly press the case 200.

The support bracket 300 may include a bracket bent member 320 being bent forward or rearward from the bracket flat member 310 and extending upward or downward. Accordingly, as the fastening member 400 is fastened to the cooling module 900, the support bracket 300 may be bent in a direction in which the fastening member 400 presses the support bracket 300. The support bracket 300 may apply an elastic force to the fastening member 400 in a direction opposite to the direction in which the fastening member 400 presses the support bracket 300. Accordingly, the fastening member 400 may strongly fix the case 200 to the cooling module 900.

In other words, the support bracket 300 may reduce the pressure that is applied to the case 200 by the fastening member 400.

The bracket flat member 310 of the support bracket 300 may have a cross-sectional area greater than that of the head 410 of the fastening member 400. Accordingly, the pressure applied to the bracket flat member 310 by the head 410 may be dispersed.

The support bracket 300 may be provided to apply an elastic force to the fastening member 400 in a direction opposite to the direction in which the fastening member 400 presses the support bracket 300. For this, the support bracket 300 may include a material having an elastic force. The coupling between the fastening member 400 and the cooling module 900 may be strengthened by the elastic force.

As mentioned above, when the support bracket 300 includes the bracket bent member 320, the bracket flat member 310 may be positioned to be spaced apart from the case 200 by the bracket bent member 320, and thus a space in which the bracket flat member 310 is bent may be formed. Accordingly, the bracket flat member 310 may be deformed, and thus an elastic force may be generated.

The support bracket 300 may include a material having elasticity. Particularly, the support bracket 300 may be formed of a metal material.

Figure 13:
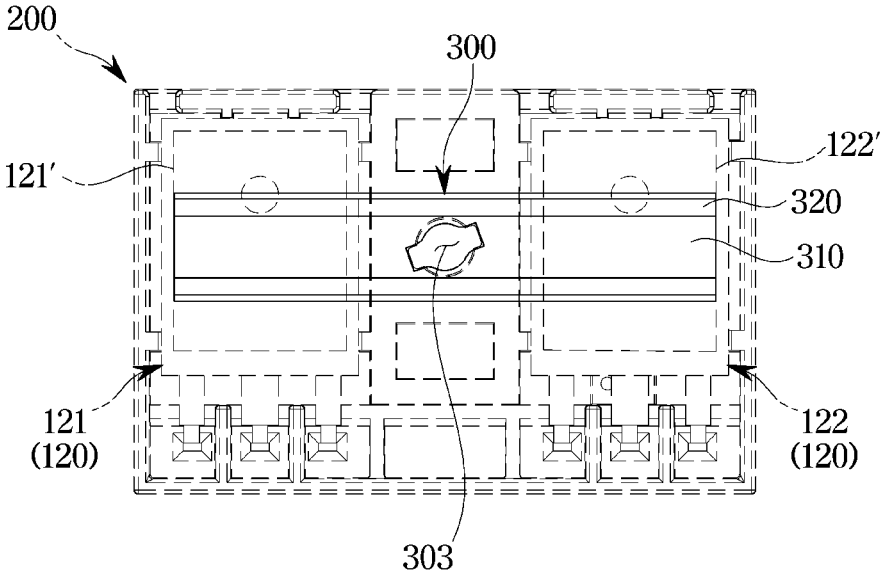
FIG. 13 is a rear view illustrating a state in which the heating element and the support bracket are accommodated in the case of FIG. 10 according to an embodiment of the disclosure.

FIG. 13 is a rear view illustrating a state in which the heating element 120 and the support bracket 300 are accommodated in the case 200 of FIG. 10.

As illustrated in FIG. 13, the support bracket 300 may be provided to cover an edge of the first heating element 121 and an edge of the second heating element 122.

The heating element body 123 of the first heating element 121 may have a rectangular parallelepiped shape, and the heating element body 123 of the second heating element 122 may have a rectangular parallelepiped shape. When it is assumed that the first heating element 121 and the second heating element 122 are arranged side by side, the support bracket 300 may be formed with a length that corresponds to a distance between a first edge 121', which is located farthest from the second heating element 122, of the first heating element 121 and a second edge 122', which is located farthest from first heating element 121, of the second heating element 122. The support bracket 300 may extend from the first edge 121' to the second edge 122' in a direction in which first heating element 121 and the second heating element 122 are arranged. Alternatively, the support bracket 300 may be formed to have a longer length than the distance from the first edge 121' to the second edge 122'.

In other words, the support bracket 300 may extend to cover the first heating element 121 and the second heating element 122.

With this structure, the support bracket 300 may distribute the pressure of the fastening member 400. The fastening member 400 may press the support bracket 300 while being fastened to the cooling module 900. At this time, the pressure of the fastening member 400 pressing the support bracket 300 against the case 200 may be distributed.

Figure 14:
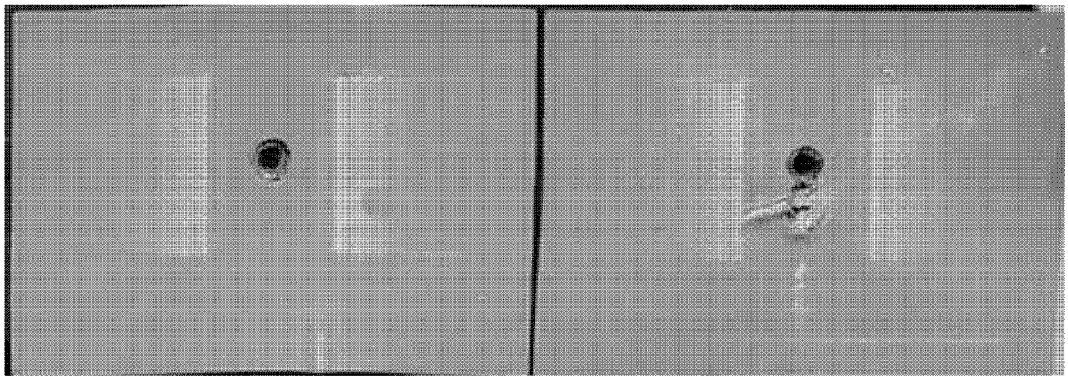
FIG. 14 is a photograph illustrating a mark left by the heating element on a shielding sheet when using a support bracket having a shorter length than the support bracket of FIG. 13 according to an embodiment of the disclosure.

FIG. 14 is a photograph illustrating a mark left by the heating element 120 on the shielding sheet 500 when using a support bracket 300 having a shorter length than the support bracket 300 of FIG. 13.

As illustrated in FIG. 14, when the support bracket 300 is not formed to have a length to cover the first edge 121' and the second edge 122', a force may not be uniformly applied to the first heating element 121 and the second heating element 122.

As can be seen in FIG. 14, when the support bracket 300 is short, the pressure may be applied only to a portion of the heating element 120 corresponding to the support bracket 300.

When the heating element 120 is uniformly pressurized, a gap between the heating element 120 and the cooling module 900 may be reduced. Accordingly, the heat transfer between the heating element 120 and the cooling module 900 may be increased.

Figure 15:
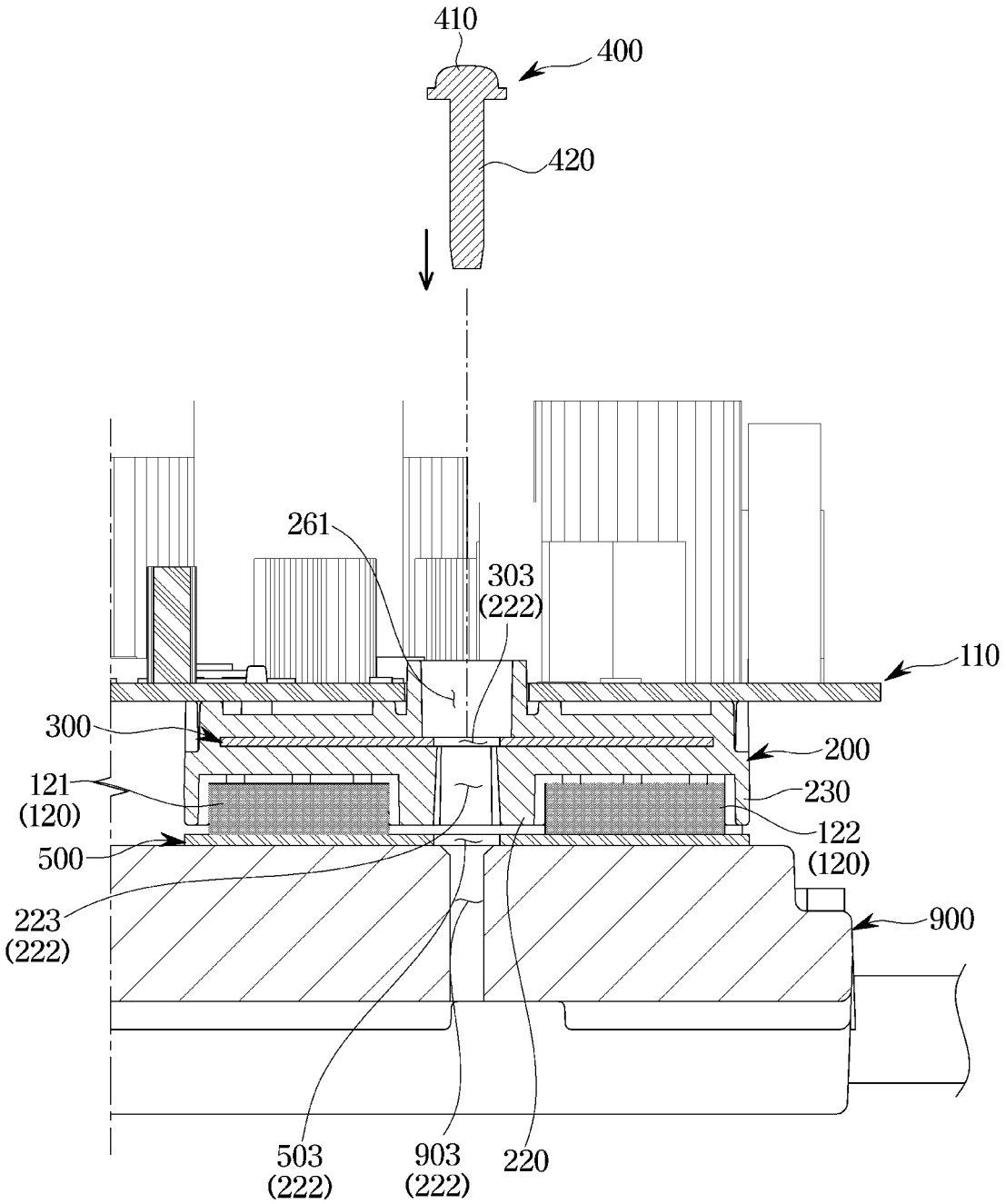
FIG. 15 is a cross-sectional view taken along line AA' in a state before a fastening member is assembled to a cooling module of the board assembly of FIG. 6 according to an embodiment of the disclosure.

FIG. 15 is a cross-sectional view taken along line AA' in a state before a fastening member 400 is assembled to the cooling module 900 of the board assembly 100 of FIG. 6

As shown in FIG. 15, the fastening member 400 may pass through the receiving hole 261, the third through-hole 303, the first through-hole 223 and the fifth through-hole 503, and then be fastened to the second through hole 903 on the cooling module 900.

The fastening member 400 may include the head 410 having a larger diameter than that of the third through hole 303. The fastening member 400 may include a neck 420 having a diameter smaller than that of the head 410 to pass through the third through-hole 303 and extending from the head 410.

Therefore, when the head 410 does not pass through the third through-hole 303 but presses the support bracket 300 against the cooling module 900, the support bracket 300 may press the case 200 against the cooling module 900. When the case 200 is pressed against the cooling module 900, the case 200 may press the heating element 120 against the cooling module 900.

The shielding sheet 500 may be provided between the heating element 120 and the cooling module 900, and thus when the heating element 120 is pressed against the cooling module 900, the heating element 120 may press the shielding sheet 500 against the cooling module 900.

When the heating element 120 is pressed against the cooling module 900, a minute gap between the heating element 120 and the cooling module 900 is reduced. The minute gap contains air. As for the heat transfer, because a heat transfer coefficient of air is small, it is required to reduce a thickness of an air layer. Accordingly, when the heating element 120 is pressed against the cooling module 900, the heat transfer between the heating element 120 and the cooling module is increased.

The neck 420 may pass through the first through-hole 223 and the fifth through-hole 503, and thus a diameter of the neck 420 may be less than a diameter of the first through-hole 223 and the fifth through-hole 503.

Figure 16:
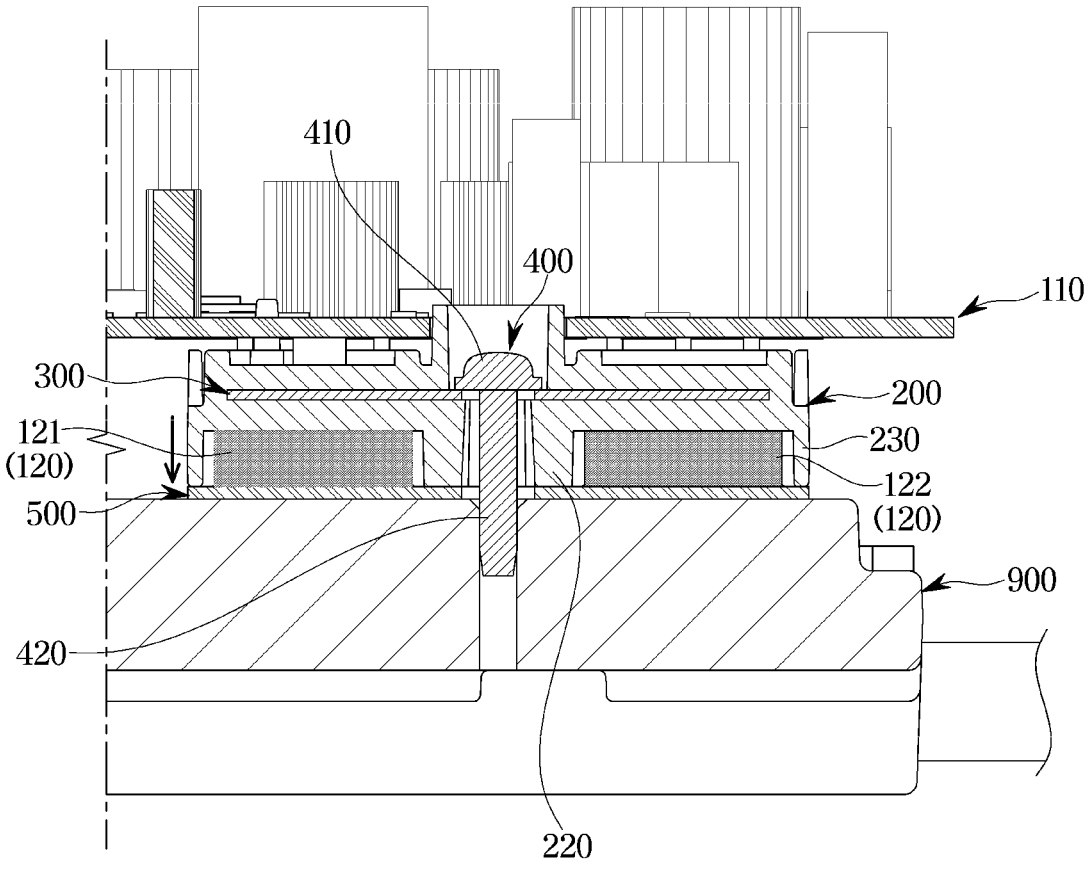
FIG. 16 is a cross-sectional view illustrating a state after the fastening member is assembled to the cooling module of the board assembly of FIG. 15 according to an embodiment of the disclosure.

FIG. 16 is a cross-sectional view illustrating a state after the fastening member 400 is assembled to the cooling module 900 of the board assembly 100 of FIG. 15.

As illustrated in FIG. 16, when the fastening member 400 is fastened to the cooling module 900, the heating element 120 may be pressed against the cooling module 900.

As mentioned above, the cooling module 900 may include a metal material. The refrigerant pipe 901 may be formed of metal, and the refrigerant pipe support member 910 may be formed of metal. In addition, the fastening member 400 fastened to the refrigerant pipe support member 910 may also be formed of metal. By using the above-mentioned structure, the electricity may flow from the refrigerant pipe 901 to the fastening member 400.

In other words, the fastening member 400 may be coupled to the refrigerant pipe support member 910, and the current generated outside the control board 110 may pass through the refrigerant pipe 901 and the refrigerant pipe support member 910 and then flow to the fastening member 400.

If an event such as lightning strikes occurs outside the outdoor unit 10 and electricity flows in the refrigerant pipe 901, the electricity may pass through the refrigerant pipe 901 and the refrigerant pipe support member 910 and then flow to the fastening member 400. When the electricity flowing to the fastening member 400 flows to the heating element 120, the heating element 120 may be damaged. In order to prevent the damage, the insulating member 220 may be arranged between the fastening member 400 and the heating element 120.

As mentioned above, the insulating member 220 may be provided to extend from the support 210 of the case 200 toward the cooling module 900. Particularly, the insulating member 220 may be provided to extend from a portion of the support 210 positioned between the fastening member 400 and the heating element 120.

At this time, it is appropriate that the insulating member 220 serves to block the current flowing from the fastening member 400 to the heating element 120. Accordingly, it is appropriate that the insulating member 220 includes an insulating material that does not conduct electricity. Particularly, it is appropriate that the insulating member 220 includes a plastic material.

As mentioned above, the refrigerant pipe support member 910 may include a metal material. Because the metal material is a material through which electricity flows, the electricity may flow through the heating element 120 through the refrigerant pipe support member 910. However, the shielding sheet 500 may be provided between the heating element 120 and the refrigerant pipe support member 910. The shielding sheet 500 may prevent a current, which flows along the refrigerant pipe support member 910, from flowing to the heating element 120.

Particularly, in order to quickly lower the temperature of the heating element 120, the heating element 120 may include the metal contact member 126 on a side facing the cooling module 900. Because the metal material is a material through which electricity easily flows, it is required that the shielding sheet 500 is arranged between the metal contact member 126 and the metal refrigerant pipe support member 910 so as to prevent the electricity from flowing to the heating element 120.

It is appropriate that the shielding sheet 500 is an insulator. Particularly, it is appropriate that the shielding sheet 500 includes a silicone material. Accordingly, while the shielding sheet 500 is in close contact with the cooling module 900 or the heating element 120, the shielding sheet 500 may prevent the current, which flows through the cooling module 900, from flowing to the heating element 120.

The shielding sheet 500 may be provided to cover all of the contact members 126.

The shielding sheet 500 may include a first shielding sheet (not shown) provided to cover the contact member 126 of the first heating element 121 and a second shielding sheet (not shown) provided to cover the contact member 126 of the second heating element 122. The shielding sheet 500 may be provided to simultaneously cover the contact member 126 of the first heating element 121 and the contact member 126 of the second heating element 122. Accordingly, a time for disposing the shielding sheet 500 may be reduced, and thus a time for producing the board assembly 100 may be reduced.

As mentioned above, the case 200 may include the insulating wall 230 extending from the support 210 toward the cooling module 900. The insulating wall 230 may cover at least a portion, which is not covered by the insulating member 220, of the side surface of the heating element 120 so as to prevent a current, which is generated outside the heating element 120, from being conducted to the heating element 120.

When the fastening member 400 is fastened to the cooling module 900, the insulating wall 230 may be in contact with the shielding sheet 500. However, the disclosure is not limited thereto and thus the insulating wall 230 may be in contact with the cooling module 900. The insulating member 220 may be in contact with the shielding sheet 500.

The lead wire 128 may extend from one side of the heating element body 123 to be connected to the baseboard 111. The other side of the heating element 120 may be surrounded by the support 210, the insulating member 220, the insulating wall 230, and the shielding sheet 500. Accordingly, a current generated outside the control board 110 may be prevented from flowing in the heating element 120.

The case 200 may be formed by injecting plastic. Accordingly, the insulating member 220 and the insulating wall may be formed by including a plastic material.

The case 200 may be coupled by being press-fitted to one side of the baseboard 111. When the fastening member 400 is fastened to the cooling module 900, the fastening member 400 may move the case 200 toward the cooling module 900 so as to allow the heating element 120 to be pressed against the cooling module 900 by the case 200.

In a process of assembling the board assembly 100 to the inside of the outdoor unit 10, the control board 110 is first fixed to the control box body 101. The cooling module 900 is also fixed to the inside of the outdoor unit 10. The case 200 may be moved to press the heating element 120 while the control board 110 and the cooling module 900 are fixed. This is because the case 200 is in a state of being press-fitted to the baseboard 111 of the control board 110 to be movable. Because the case 200 is movable, the case 200 may be moved to press the heating element 120 against the cooling module 900.

An experiment is performed to check whether the current flows or not after surrounding the heating element 120 with the insulating member 220 and the insulating wall. A table below is a table summarizing the experimental results of checking whether the current flows in the heating element 120 and accordingly, whether the heating element 120 does not operate normally, caused by a malfunction or damage in a component.

TABLE 1

| | 1 KV (+/−) | 2 KV (+/−) | 3 KV (+/−) | 4 KV (+/−) | 5 KV (+/−) | 6 KV (+/−) | 7 KV (+/−) | 8 KV (+/−) |
|---|---|---|---|---|---|---|---|---|
| malfunction | ok/ok | ok/ok | ok/ok | ok/ok | ok/ok | ok/ok | ok/ok | ok/ok |
| Component destroy | ok/ok | ok/ok | ok/ok | ok/ok | ok/ok | ok/ok | ok/ok | ok/ok |
| Output value of sensor | ok/ok | ok/ok | ok/ok | ok/ok | ok/ok | ok/ok | ok/ok | ok/ok |

As seen in table 1, the experiment is performed by applying 1 KV to 8 KV to the fastening member 400 of the above embodiment. As can be seen from the results, in the case of the above embodiment, it is found that the heating element 120 does not malfunction.

As the fastening member 400 is fastened to the cooling module 900, a temperature drop is tested. A table below is a table summarizing the results of experiments in which the temperature of the heating element 120 is decreased by applying the above embodiment.

TABLE 2

| | |
|---|---|
| L-IGBT(° C.) | 77.7 |
| L-Diode(° C.) | 60.2 |
| R-IGBT(° C.) | 80.2 |
| R-Diode(° C.) | 55.9 |

As seen in table 2, the experiment is conducted using the first heating element 121 as an IGBT and the second heating element 122 as a diode. As a result of the experiment, the temperature of both the first heating element 121 and the second heating element 122 is 90 degrees Celsius or less. Accordingly, it can be seen that the embodiment of the disclosure includes a structure suitable for cooling the heating element 120.

Hereinafter another embodiment to which the disclosure is applied will be described. The same reference numerals are assigned to the same components as those of the air conditioner 1 shown above, and detailed descriptions thereof may be omitted.

Figure 17:
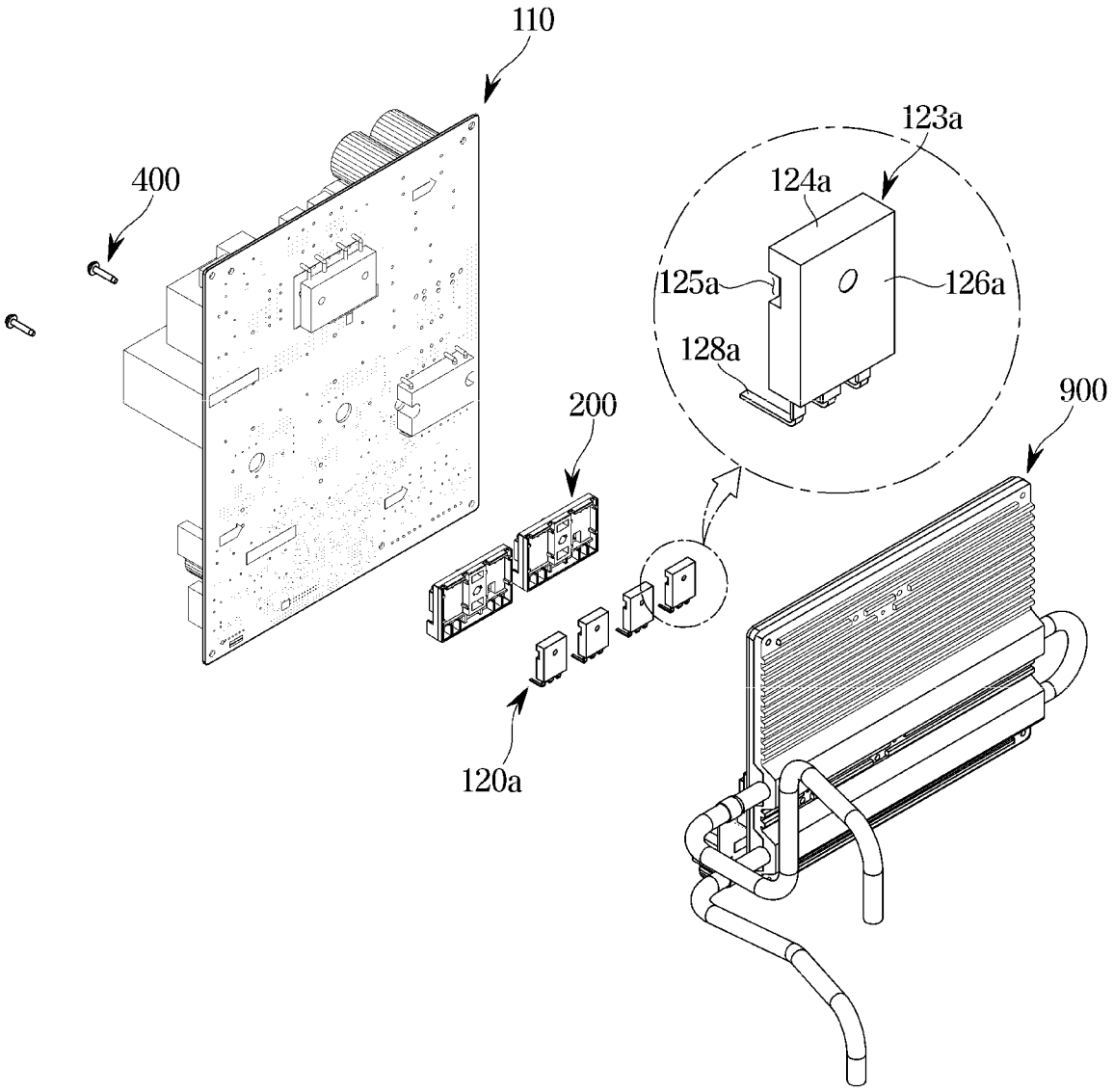
FIG. 17 is a rear perspective view illustrating a board assembly according to an embodiment of the disclosure.

FIG. 17 is a rear perspective view illustrating a board assembly according to an embodiment of the disclosure.

As illustrated in FIG. 17, a contact member **126*a* of a heating element 120*a* may include the same material as a heating element cover 124*a***.

The heating element cover **124*a* may include an insulator, and thus the contact member 126*a* of the heating element 120*a*** may include an insulator.

When the contact member **126*a* of the heating element 120*a* in contact with the cooling module 900 is an insulator, a current, which flows through the cooling module 900, may not flow to the heating element 120*a*. Therefore, the shielding sheet 500** may not be included.

As illustrated in FIG. 17, when an embodiment in which the contact member **126*a* of the heating element 120*a* is provided as an insulator is applied to another embodiment of the disclosure, the shielding sheet 500** may not be included.

Figure 18:
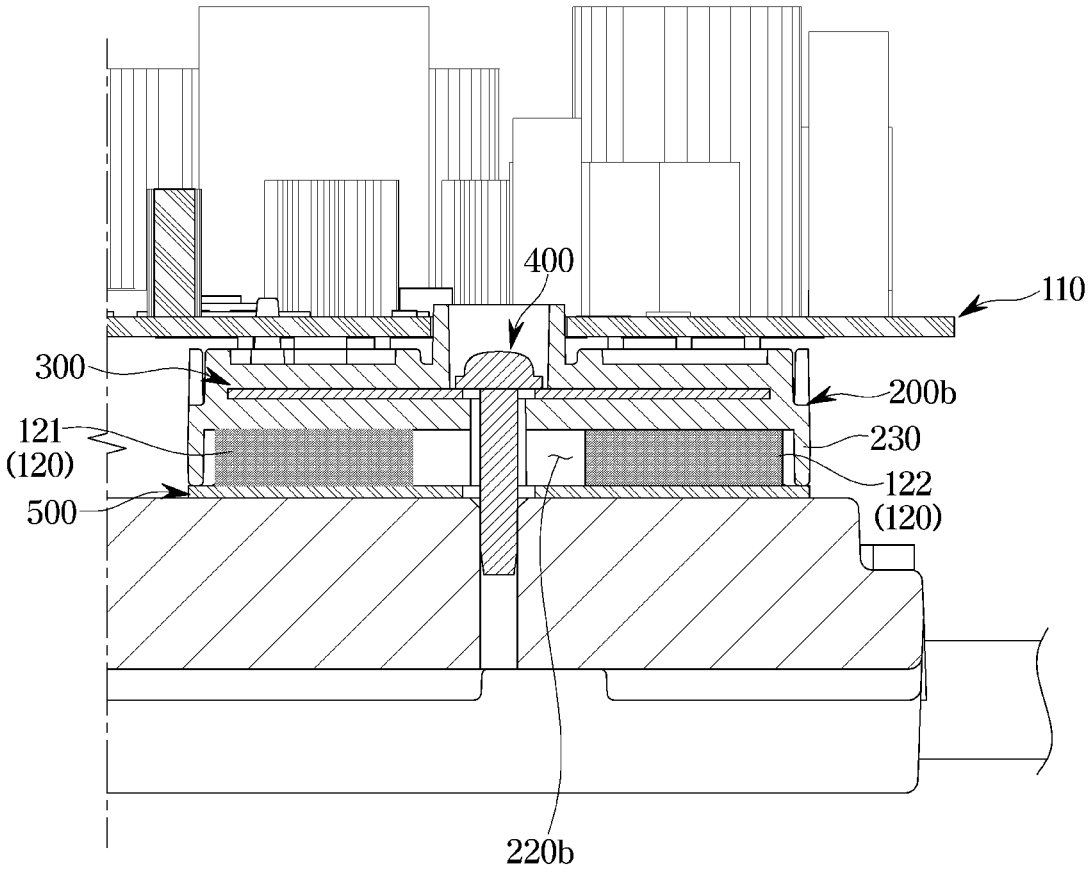
FIG. 18 is a cross-sectional view illustrating the board assembly according to an embodiment of the disclosure.

FIG. 18 is a cross-sectional view illustrating the board assembly 100 according to an embodiment of the disclosure.

As illustrated in FIG. 18, an insulating member 220*b* of a case 200*b* may be a space between the heating element 120 and the fastening member 400.

Air may be accommodated in the insulating member 220*b*. Because air functions as an insulator, a current may not flow between the fastening member 400 and the heating element 120.

However, it is required to increase a distance between the fastening member 400 and the heating element 120 in comparison with the above-mentioned embodiment. This is because the current may flow to the heating element 120 when a high voltage is applied to the fastening member 400.

It is appropriate that the distance between the fastening member 400 and the heating element 120 is 10 mm or more.

Figure 19:
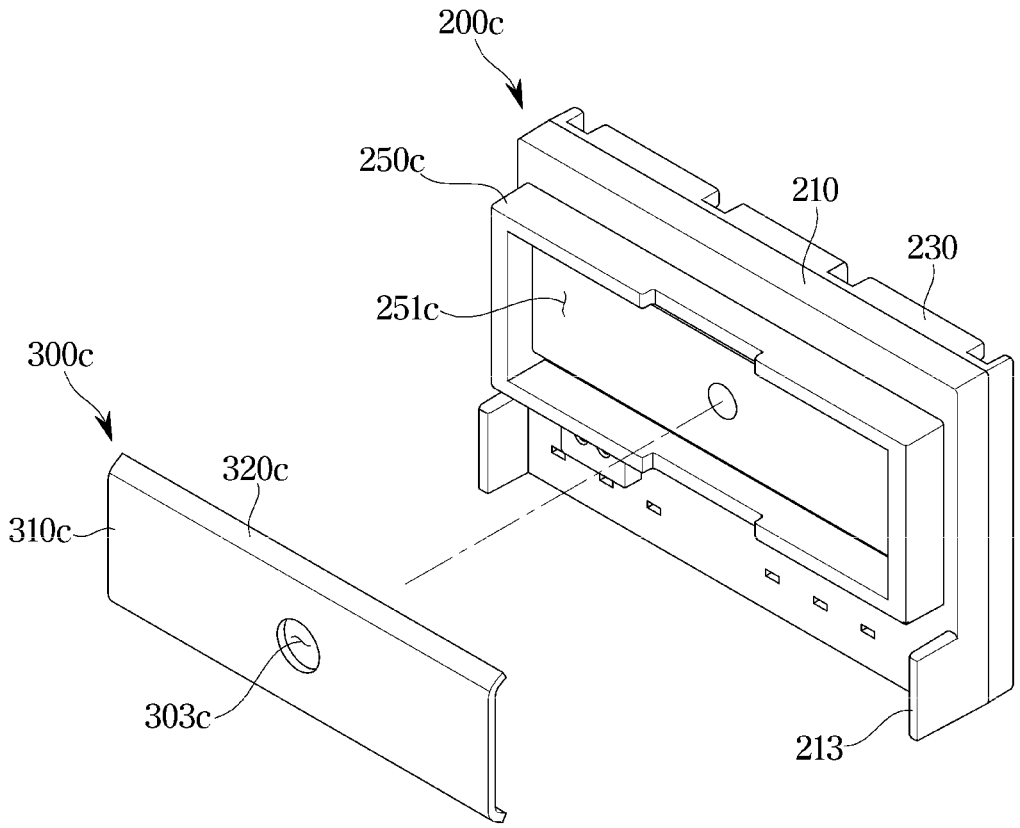
FIG. 19 is a perspective view illustrating a case and a support bracket according to an embodiment of the disclosure.

FIG. 19 is a perspective view illustrating a case 200*c* and a support bracket 300*c* according to an embodiment of the disclosure.

As illustrated in FIG. 19, the support bracket 300*c* may be provided separately from the case 200*c*.

The support bracket 300*c* may include a bracket flat member 310*c* and a bracket bent member 320*c* bent and extending from the bracket flat member 310*c*. A third through-hole 303*c* formed at a position corresponding to a first through hole 223*c* formed in the case 200*c* may be formed in the bracket flat member 310*c*.

A support protruding member 250*c* protruding forward may be provided in a front portion of the case 200*c*. A support recess 251*c* recessed backward to correspond to the support bracket 300*c* may be provided in the support protruding member 250*c* to accommodate the support bracket 300*c*. The support recess 251*c* may guide the support bracket 300*c* to be accommodated in the case 200*c*.

The support bracket 300*c* may be positioned between the baseboard 111 and the case 200*c*.

The support bracket 300*c* may be positioned between the support 210 and a heating element 200.

Figure 20:
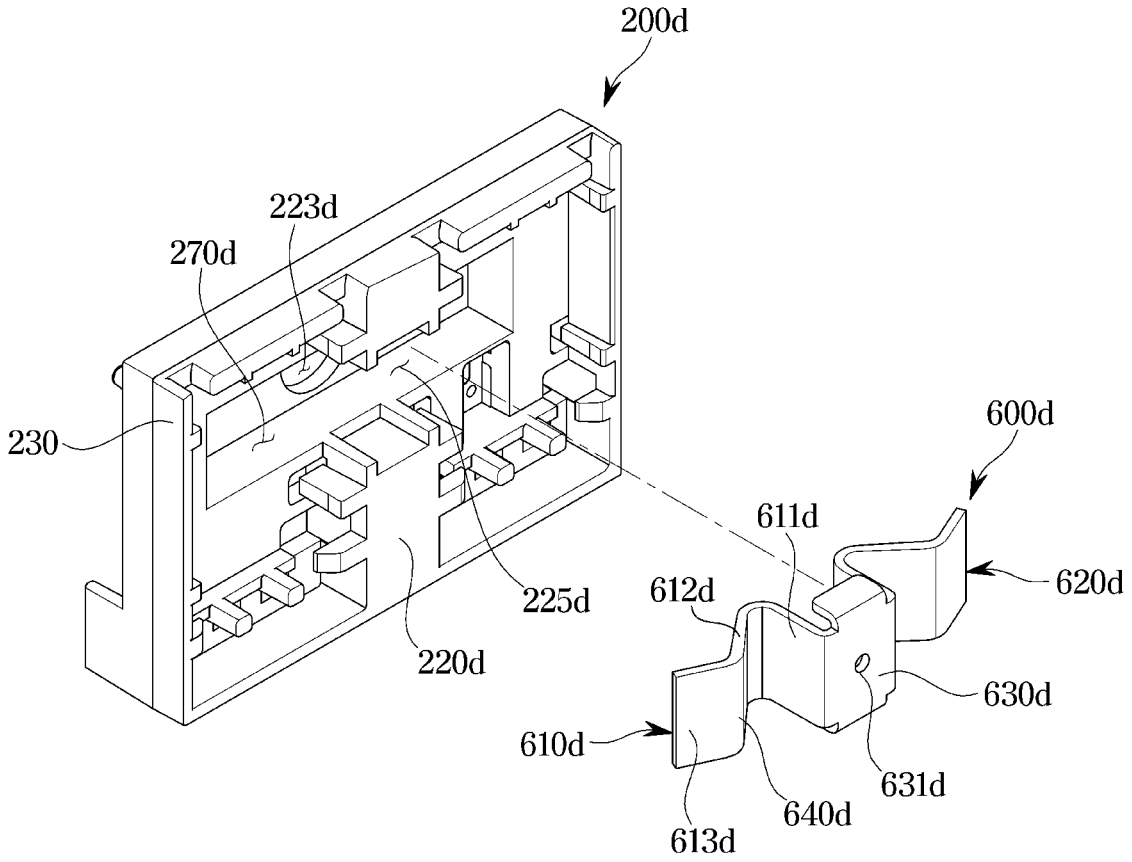
FIG. 20 is a rear perspective view illustrating a case and a support bracket according to an embodiment of the disclosure.

FIG. 20 is a rear perspective view illustrating a case 200*d* and a support bracket 600*d* according to an embodiment of the disclosure.

As illustrated in FIG. 20, a board assembly 100*d* may include a support bracket 600*d* between the case 200*d* and the heating element 120.

In other words, the board assembly 100*d* may include the support bracket 600*d* disposed between the support 210 and the heating element 120 to elastically bias the heating element 120 toward the cooling module 900.

The case 200*d* may include an elastic member accommodating space 270*d* in which the support bracket 600*d* is accommodated. The elastic member accommodating space 270*d* may be provided to recessed forward.

In other words, the support bracket 600*d* may be provided inside the case 200*d*.

The support bracket 600*d* may include an extension 610*d* or a first extension 610*d* extending in a first direction. The support bracket 600*d* may include a second extension 620*d* extending in a second direction different from the first direction. The support bracket 600*d* may include a connector 630*d* connecting the first extension 610*d* and the second extension 620*d*.

The first extension 610*d* may include a first member 611*d* extending forward. The first extension 610*d* may include a second member 612*d* that is bent backward from the first member 611*d* and extends in the first direction to be inclined backward. The first extension 610*d* may include a third member 613*d* that is bent forward at an end of the second member 612*d* and extends in the first direction to be inclined forward.

A pressing member 640*d* may be provided at a position where the third member 613*d* extends from the second member 612*d*. The first extension 610*d* and the second extension 620*d* may be symmetrical with respect to the connector 630*d*.

A sixth through-hole 631*d* may be formed in the connector 630*d*. The sixth through-hole 631*d* may be formed at a position corresponding to the first through-hole 223*d* formed on the case 200*d*.

The connector 630*d* may include a shape that is bent and extends forwardly from a side not connected to the first extension 610*d* and the second extension 620*d*.

According to the shape of the connector 630*d*, a through space 225*d* may be formed on the case 200*d*. An insulating member 220*d* may be disposed above or below the through space 225*d*.

Figure 21:
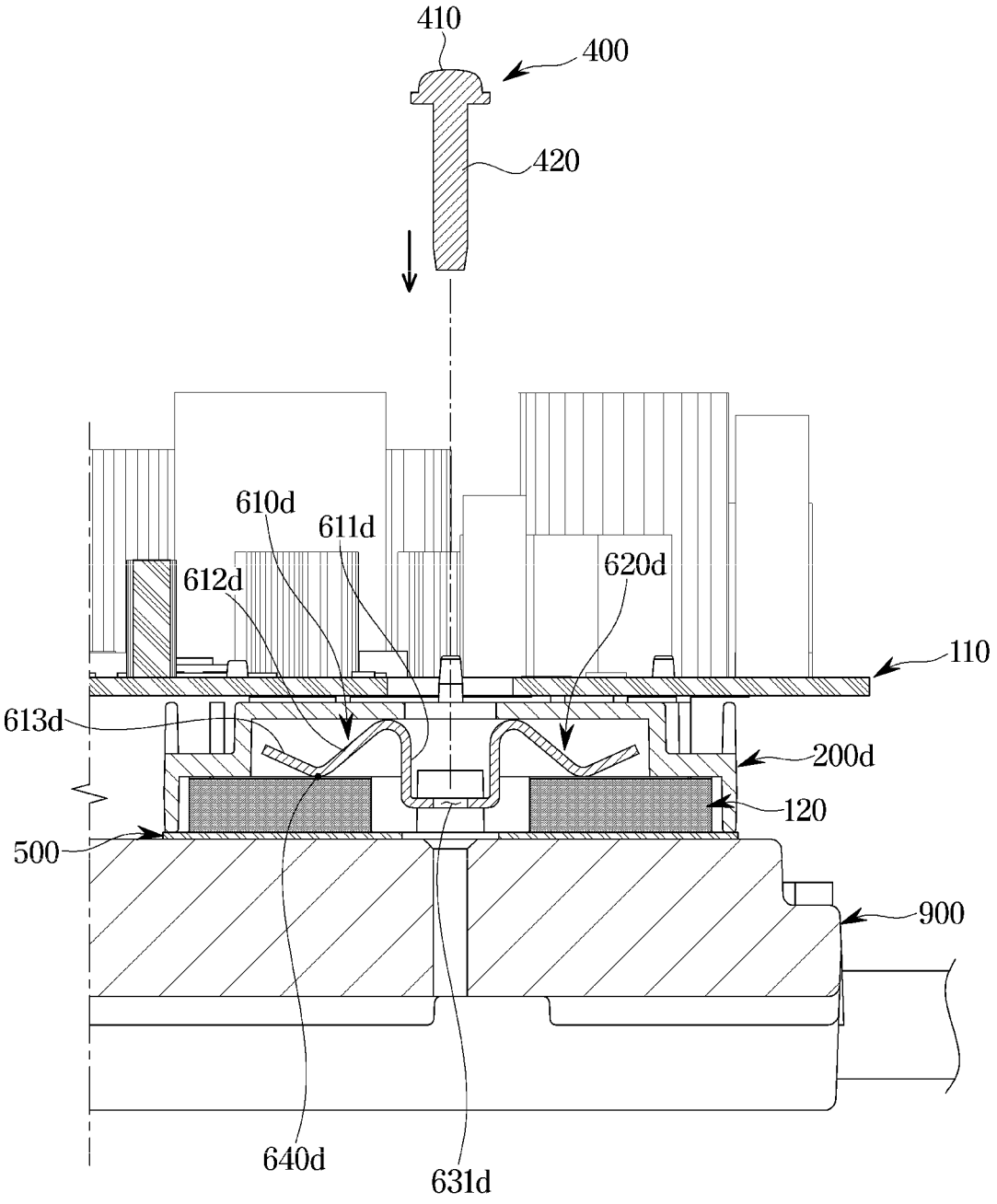
FIG. 21 is a cross-sectional view illustrating a state before the fastening member is assembled to the cooling module in the board assembly including the case and the support bracket of FIG. 20 according to an embodiment of the disclosure.
Figure 22:
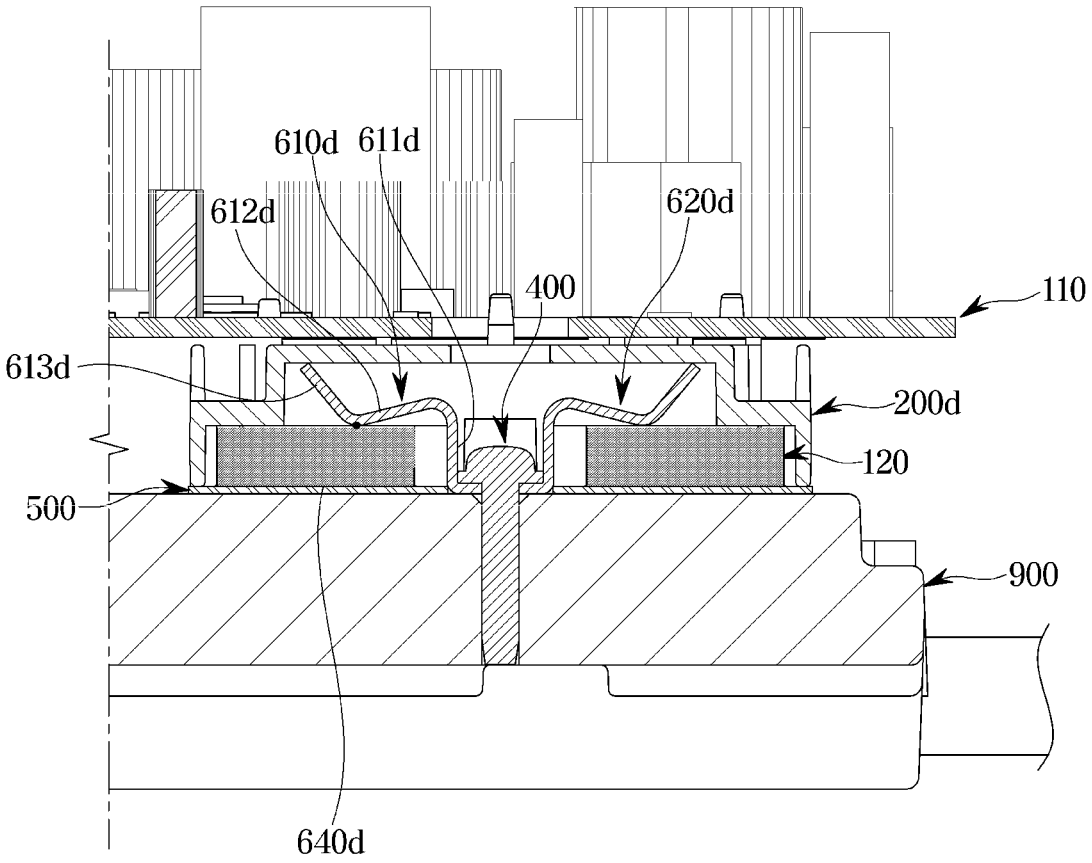
FIG. 22 is a cross-sectional view illustrating a state after the fastening member is assembled to the cooling module of the board assembly of FIG. 21 according to an embodiment of the disclosure.

FIG. 21 is a cross-sectional view illustrating a state before the fastening member 400 is assembled to the cooling module 900 in the board assembly 100*d* including the case 200*d* and the support bracket 600*d* of FIG. 20. FIG. 22 is a cross-sectional view illustrating a state after the fastening member 400 is assembled to the cooling module 900 of the board assembly 100*d* of FIG. 21.

As illustrated in FIGS. 21 and 22, the fastening member 400 may pass through the first through-hole 223*d* and the third through-hole 303*d* and then be fastened to the cooling module 900*d*.

Before the fastening member 400 is fastened to the cooling module 900, the support bracket 600*d* may be arranged above the heating element 120. At this time, the pressing member 640*d* of the support bracket 600*d* may be in contact with the heating element 120.

That is, the first extension 610*d* or the second extension 620*d* is provided to press the heating element 120 against the cooling module 900 when the fastening member 400 is fastened to the cooling module 900.

The connector 630*d* of the support bracket 600*d* may be disposed to be spaced apart from the cooling module 900.

The neck 420 of the fastening member 400 may pass through the sixth through-hole 631*d* formed in the connector 630*d* and then be fastened to the cooling module 900. The head 410 of the fastening member 400 may not pass through the sixth through-hole 631*d* and may press the connector 630*d* against the cooling module 900. Accordingly, as the fastening member 900 is fastened to the cooling module 900, the connector 630*d* of the support bracket 600*d* may be moved toward the cooling module 900.

In a process in which the fastening member 400 is fastened to the cooling module 900, the connector 630*d* of the support bracket 600*d* may be moved toward the cooling module 900. The second member 612*d* and the third member 613*d* of the first extension 610*d* may be moved forward. The first member 611*d* may be moved in parallel toward the cooling module 900. The second member 612*d* may pivot around a portion where the first member 611*d* and the second member 612*d* are connected. The third member 613*d* may pivot around the pressing member 640*d*. The pressing member 640*d* may press the heating element 120 against the cooling module 900.

At this time, it is required to prevent the current, which flows through the fastening member 400, from flowing to the heating element 120 through the support bracket 600*d*. Accordingly, the support bracket 600*d* may include an insulator.

Additionally, the support bracket 600*d* may be painted with an insulating material.

The support bracket 600*d* according to the embodiment may perform a function similar to that of the elastic member 600*e* described below.

Figure 23:
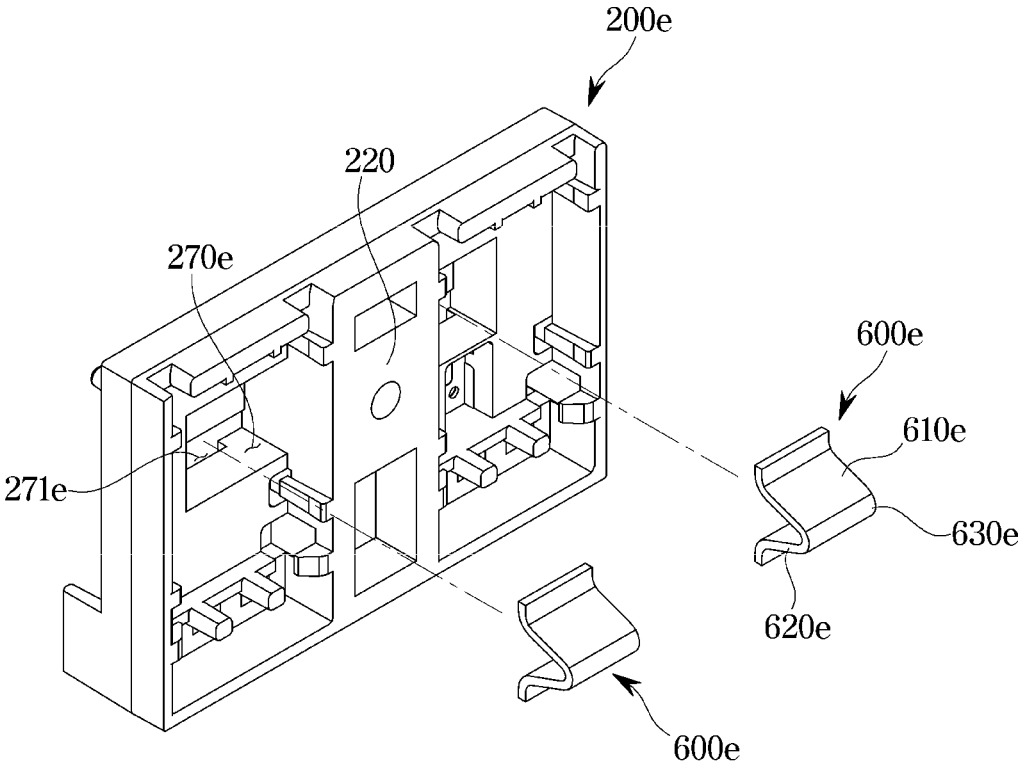
FIG. 23 is a rear perspective view illustrating a case and an elastic member according to an embodiment of the disclosure.

FIG. 23 is a rear perspective view illustrating a case 200*e* and an elastic member 600*e* according to an embodiment of the disclosure.

As illustrated in FIG. 23, the case 200*e* may include an elastic member accommodating space 270*e* in which the elastic member 600*e* is accommodated. The elastic member accommodating space 270*e* may be provided to be recessed forward.

The elastic member 600*e* may include a first extension 610*e* extending in a first direction. The elastic member 600*e* may include a second extension 620*e* extending in a second direction different from the first direction. The elastic member 600*e* may include a connector 630*e* connecting the first extension 610*e* and the second extension 620*e*.

The first extension 610*e* may include an end extending in the first direction and then bent upward or downward to extend. The second extension 620*e* may also include an end corresponding to the end of the first extension 610*e*.

The case 200*e* may include an accommodating member 271*e* extending from the elastic member accommodating space 270*e* to accommodate the end of the first extension 610*e* and the end of the second extension 620*e*.

Figure 24:
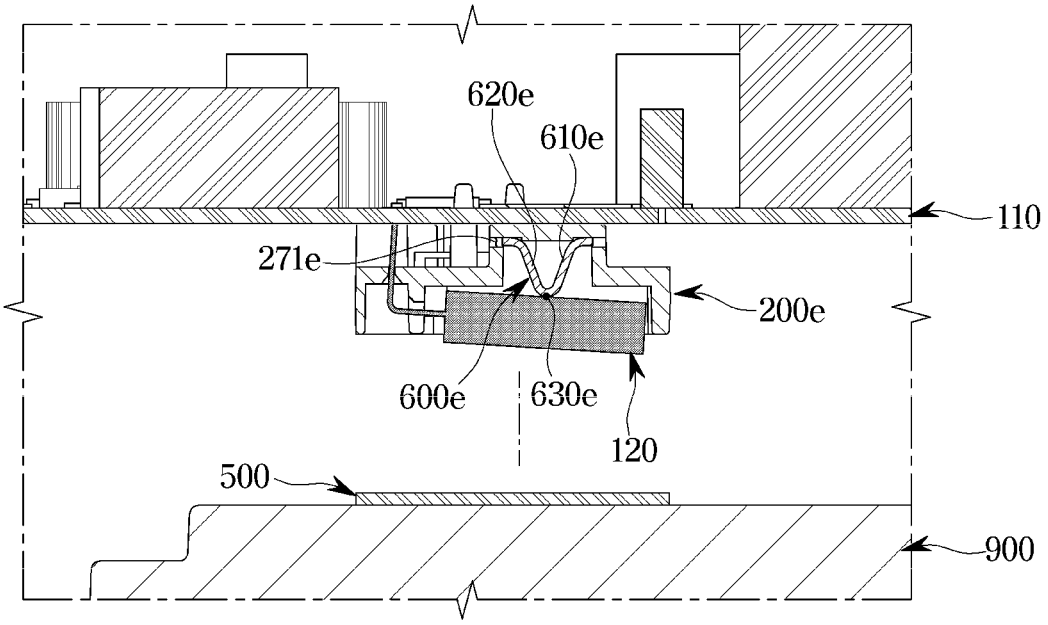
FIG. 24 is a cross-sectional view illustrating a state before the fastening member is assembled to the cooling module in a board assembly including the case and the elastic member of FIG. 23 according to an embodiment of the disclosure.
Figure 25:
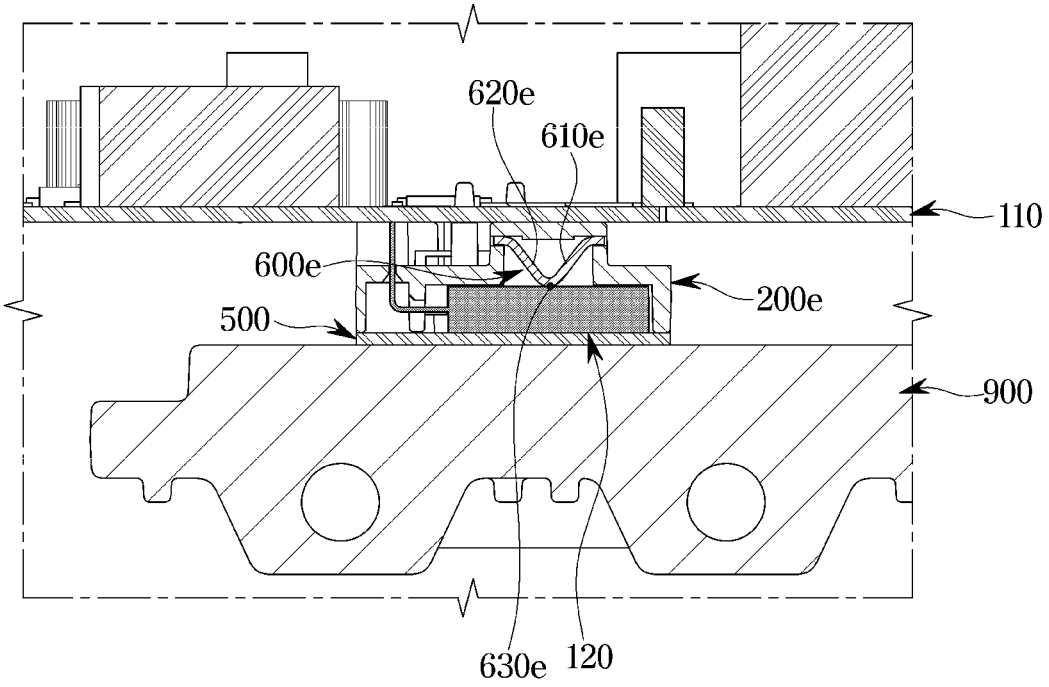
FIG. 25 is a cross-sectional view illustrating a state after the fastening member is assembled to the cooling module of the board assembly of FIG. 24 according to an embodiment of the disclosure.

FIG. 24 is a cross-sectional view illustrating a state before the fastening member 400 is assembled to the cooling module 900 in a board assembly 100*e* including the case 200*e* and the elastic member 600*e* of FIG. 23. FIG. 25 is a cross-sectional view illustrating a state after the fastening member 400 is assembled to the cooling module 900 of the board assembly 100*e* of FIG. 24.

As illustrated in FIGS. 24 and 25, when the fastening member 400 is fastened to the cooling module 900, the end of the first extension 610*e* and the end of the second extension 620*e* may be accommodated in the accommodating member 271*e* and the connector 630*e* may be in contact with the heating element 120 to press the heating element 120 against the cooling module 900.

Figure 26:
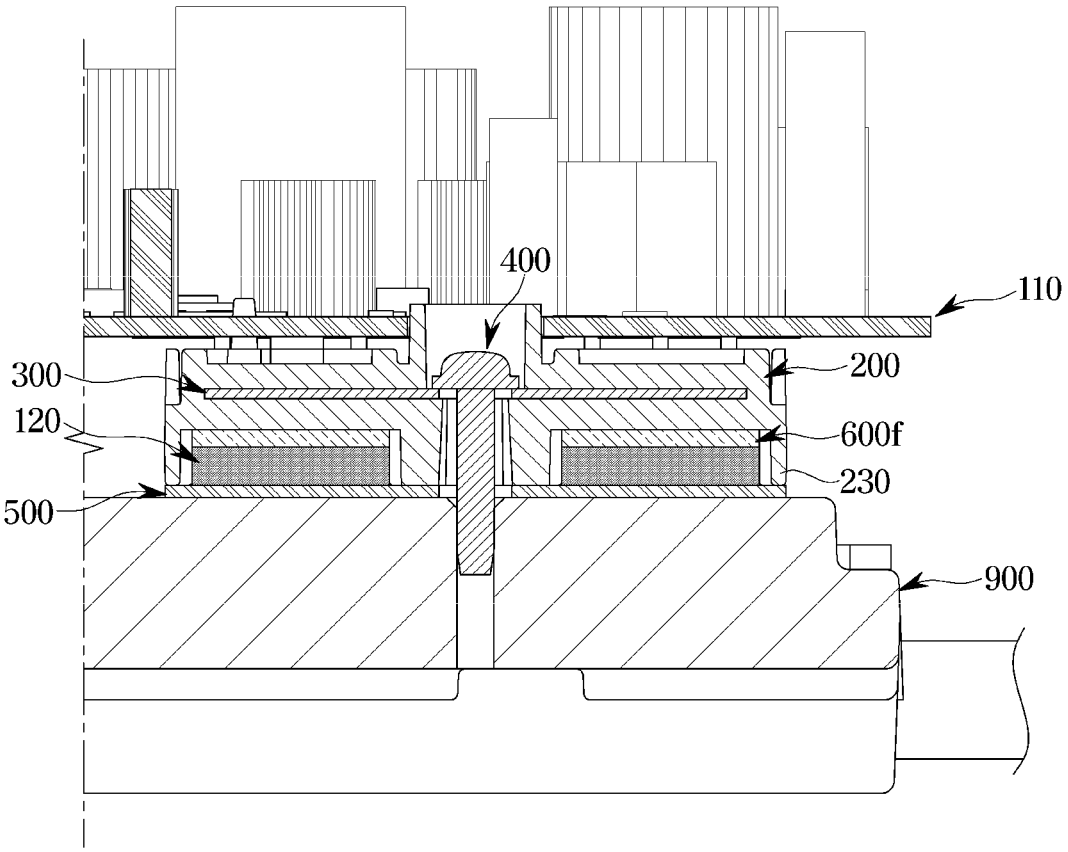
FIG. 26 is a cross-sectional view illustrating a board assembly including an elastic member according to an embodiment of the disclosure.

FIG. 26 is a cross-sectional view illustrating a board assembly 100*f* including an elastic member 600*f* according to an embodiment of the disclosure.

As illustrated in FIG. 26, the elastic member 600*f* may be disposed between the heating element 120 and the support 210 of the case 200.

The elastic member 600*f* may be in the form of a pillar having a predetermined height.

The elastic member 600*f* may be a component having elasticity such as a spring, a leaf spring, or a sponge. The elastic member 600*f* may vary as long as having elasticity.

When the fastening member 400 is fastened to the cooling module 900, the elastic member 600*f* may be compressed. The elastic member 600*f* may press the heating element 120 in a direction opposite to the direction in which the elastic member 600 is compressed. Accordingly, the heating element 120 may be pressed against the cooling module 900.

As is apparent from the above description, as a heating element in a board assembly is located on a rear surface of the board assembly, the board assembly may be less affected by the heating element even when the heating element generates heat.

Further, a board assembly includes a fastening member provided to allow a heating element to be in close contact with a cooling module, and thus it is possible to effectively dissipate heat generated by the heating element.

Further, a board assembly includes an insulating member arranged between a fastening member and a heating element, and thus a current may not flow between the fastening member and the heating element.

According to an embodiment of the disclosure, a board assembly may include a control board including a heating element, a case in contact with the control board and provided to accommodate the heating element, a cooling module arranged adjacent to the heating element so as to cool the heating element, a fastening member provided to pass through the case and coupled to the cooling module so as to fix the case to the cooling module, and a support bracket arranged between the fastening member and case so as to reduce a pressure applied to the case by the fastening member. The fastening member may press the support bracket, and the support bracket may be provided to apply an elastic force to the fastening member in a direction opposite to a direction in which the fastening member presses the support bracket. The case may extend in a first direction, and the support bracket may include a bracket flat member extending in the first direction. A through-hole may be formed in the support bracket. The fastening member may include a head having a diameter greater than a diameter of the through-hole, and a neck having a diameter less than the diameter of the head so as to pass through the through-hole and extending from the head. The bracket flat member of the support bracket may have a cross-sectional area greater than a cross-sectional area of the head. The support bracket may include a bracket bent member that is bent and extends from the end of the bracket flat member. A first heating element and a second heating element arranged in a first direction with respect to the first heating element may be arranged on one side of the case. The support bracket may extend to cover the first heating element and the second heating element in the first direction. The support bracket may be provided inside the case. The support bracket may be formed by insert molding into the case. The support bracket may be disposed between the control board and the case. The case may include a support positioned between the control board and the cooling module, and the support bracket may be positioned between the support and the heating element. The support bracket may include an extension positioned between the support and the heating element and extending in a lateral direction, and a connector being bent and extending from the extension to allow the fastening member to pass therethrough. The extension may include a first member bent from the connector to extend forward, a second member bent backward from an end of the first member and extending in a lateral direction to be inclined, a third member bent forward from an end of the second member and extending in the lateral direction to be inclined forward, and a pressing member formed between the second member and the third member to press the heating element against the cooling module. In response to the fastening member being fastened to the cooling module, the connector and the first member may be moved to the cooling module, the third member may pivot around the pressing member to a direction opposite to the heating element, and the pressing member may press the heating element. The case may be coupled to the rear side of the control board, the cooling module may be disposed at the rear of the case, the heat generating element may be disposed between the case and the cooling module, and the fastening member may fasten the support bracket and the cooling module. In accordance with another aspect of the disclosure, a board assembly includes the above-mentioned board assembly.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a control board including:

a baseboard, and a heating element coupled to the baseboard;

a case in contact with the control board, the case accommodating the heating element and including an insulating member;

a cooling module to cool the heating element; and a fastening member;

a shielding sheet;

wherein the case is fixed to the cooling module by the fastening member so that the heating element is adjacent to the cooling module, and the insulating member is located between the fastening member and the heating element so as to prevent a current flowing along the fastening member from flowing into the heating element, a case opening facing the cooling module is formed in the case, and the heating element includes a contact member disposed toward the cooling module through the case opening while the heating element is inside the case, wherein the shielding sheet is disposed between the contact member and the cooling module so as to prevent a current from flowing between the contact member and the cooling module.

2. The air conditioner of claim 1, wherein the case further includes:

a support between the baseboard and the cooling module, wherein the insulating member extends from the support so as to cover at least a portion of a first side surface of the heating element.

3. The air conditioner of claim 2, wherein the insulating member extends from the support to cover the first side surface, which faces the insulating member, of the heating element.

4. The air conditioner of claim 1, wherein the shielding sheet includes a silicone material.

5. The air conditioner of claim 1, wherein the cooling module includes:

a refrigerant pipe, and a refrigerant pipe support member in contact with the refrigerant pipe, the fastening member is coupled to the refrigerant pipe support member, and the fastening member is provided so that a current generated outside the control board, and which passes through the refrigerant pipe and the refrigerant pipe support member, flows to the fastening member.

6. The air conditioner of claim 1, wherein the case includes:

an insulating wall extending from a support of the case toward the cooling module and provided to cover at least a portion of a second side surface of the heating element so as to prevent a current generated outside the heating element from flowing to the heating element.

7. The air conditioner of claim 6, wherein the insulating member and the insulating wall are in contact with the shielding sheet.

8. The air conditioner of claim 7, wherein the heating element includes:

a heating element body, and a lead wire extending from one side of the heating element body to connect the baseboard and the heating element body, and at least some remaining sides of the heating element body are surrounded respectively by the support, the insulating member, the insulating wall, and the shielding sheet.

9. The air conditioner of claim 2, wherein in response to the fastening member being fastened to the cooling module, the fastening member moves the case toward the cooling module so that the heating element is pressed against the cooling module by the case.

10. The air conditioner of claim 9, wherein the heating element includes:

a first heating element, and a second heating element, the first heating element is provided on a first side of the insulating member, the second heating element is provided on a second side of the insulating member, and in response to the fastening member being fastened to the cooling module, the case presses the first heating element and the second heating element against the cooling module.

11. The air conditioner of claim 10, wherein a first through-hole, through which the fastening member passes, is formed in the support, a second through-hole is formed in the cooling module at a position so that the fastening member passes through the first through-hole into the second through-hole, the air conditioner further includes:

a support bracket provided in contact with the support and including a third through-hole formed at a position so that the fastening member passes sequentially through the third through-hole, the first through-hole, and the second through-hole, and the fastening member includes:

a head having a diameter greater than a diameter of the third through-hole, and a neck extending from the head and having a diameter less than the diameter of the head so as to pass through the third through-hole.

12. The air conditioner of claim 11, wherein the first heating element and the second heating element are arranged in a first direction on a first side of the support, the support bracket is located on a second side of the support, and the support bracket has a length in the first direction to at least equal a span of the first heating element and the second heating element in the first direction.

13. The air conditioner of claim 2, further comprising:

an elastic member disposed between the support and the heating element to elastically bias the heating element toward the cooling module.

14. The air conditioner of claim 13, wherein the elastic member includes:

a first extension extending in a first direction, a second extension extending in a second direction different from the first direction, and a connector connecting the first extension and the second extension, wherein the connector is in contact with the heating element to press the heating element toward the cooling module.

15. A board assembly comprising:

a control board including:

a baseboard, and a heating element coupled to the baseboard;

a case accommodating the heating element, and including an insulating member;

a shielding sheet; and a fastening member provided to fasten the case to a cooling module, wherein the case is configured so that the insulating member is located between the fastening member and the heating element so as to prevent a current flowing along the fastening member from flowing into the heating element, a case opening facing the cooling module is formed in the case, and the heating element includes a contact member disposed toward the cooling module through the case opening while the heating element is inside the case, wherein the shielding sheet is disposed between the contact member and the cooling module so as to prevent a current from flowing between the contact member and the cooling module.

16. The board assembly of claim 15, wherein the case further includes:

a support that is arranged between the baseboard and the cooling module when the case is fastened to the cooling module, wherein the insulating member extends from the support so as to cover at least a portion of a side surface of the heating element.

* * * * *